US011472184B2

(12) United States Patent
Kanegae et al.

(10) Patent No.: US 11,472,184 B2
(45) Date of Patent: Oct. 18, 2022

(54) LIQUID DISCHARGING APPARATUS

(71) Applicant: SEIKO EPSON CORPORATION, Tokyo (JP)

(72) Inventors: Takahiro Kanegae, Shiojiri (JP); Nobuaki Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 21 days.

(21) Appl. No.: 17/003,423

(22) Filed: Aug. 26, 2020

(65) Prior Publication Data

US 2021/0060950 A1 Mar. 4, 2021

(30) Foreign Application Priority Data

Aug. 29, 2019 (JP) ..... JP2019-156758

(51) Int. Cl.
*B41J 2/14* (2006.01)
*B41J 2/155* (2006.01)

(52) U.S. Cl.
CPC ..... *B41J 2/155* (2013.01)

(58) Field of Classification Search
CPC ... B41J 2/155; B41J 2/1433; B41J 2/14; B41J 2/16586
See application file for complete search history.

(56) References Cited

U.S. PATENT DOCUMENTS

2010/0328400 A1* 12/2010 Koda ..... B41J 2/14274 347/50
2017/0291417 A1* 10/2017 Okubo ..... B41J 2/1433

FOREIGN PATENT DOCUMENTS

JP 2017-136720 A 8/2017

* cited by examiner

*Primary Examiner* — Jason S Uhlenhake
(74) *Attorney, Agent, or Firm* — Workman Nydegger

(57) ABSTRACT

A liquid discharging apparatus may include a first head unit and a second head unit. The first head unit includes first and second parts. A position of the second part in a first direction is different from that of the first part, and a width is shorter than a width of the first part in a second direction. The second head unit includes a fourth part and a fifth part. A position of the fifth part in the first direction is different from that of the fourth part, and a width is shorter than a width of the fourth part in the second direction. The first head unit and the second head unit are disposed side by side in the second direction. At least a part of the second part and at least a part of the fifth part do not overlap with each other in the first direction.

15 Claims, 9 Drawing Sheets

LIQUID DISCHARGING APPARATUS

The present application is based on, and claims priority from JP Application Serial Number 2019-156758, filed Aug. 29, 2019, the disclosure of which is hereby incorporated by reference here in its entirety.

BACKGROUND

1. Technical Field

The present disclosure relates to a liquid discharging apparatus.

2. Related Art

In the related art, a liquid discharging apparatus that discharges a liquid such as ink has been known. For example, JP-A-2017-136720 discloses a liquid discharging apparatus having a plurality of head units provided with nozzles for discharging a liquid. The head unit included in this liquid discharging apparatus has a protruding portion having a width shorter than that of the central portion. Each of the central portion and the protruding portion is provided with nozzles.

The protruding portion of the head unit has a width shorter than that of the central portion of the head unit, and thus the heat capacity becomes small and heat is easily dissipated. Therefore, a liquid in the protruding portion tends to have a lower temperature as compared with the temperature of a liquid in the central portion. When the temperature of the liquid is low, the viscosity of the liquid increases and the discharging amount of the liquid decreases, so that a difference in the discharging amount of the liquid easily appears between the protruding portion and the central portion. In the related art, when a plurality of head units are arranged and used in a direction intersecting with an array direction of the nozzles, the protruding portion of each of the plurality of head units is disposed at the same position in the array direction. Therefore, in the related art, the above-mentioned difference in discharging amount is emphasized, and as a result, a local difference in density or overall unevenness in density occurs in a recording image, which causes a problem of image quality deterioration.

SUMMARY

According to an aspect of the present disclosure, there is provided a liquid discharging apparatus including a first head unit provided with a plurality of first nozzles that discharge a liquid, and a second head unit provided with a plurality of second nozzles that discharge the liquid, in which the first head unit includes a first part in which a part of the plurality of first nozzles is provided, and a second part in which a part of the plurality of first nozzles is provided, a position in a first direction is different from that of the first part, and a width is shorter than a width of the first part in a second direction intersecting with the first direction, the second head unit includes a fourth part in which a part of the plurality of second nozzles is provided, and a fifth part in which a part of the plurality of second nozzles is provided, a position in the first direction is different from that of the fourth part, and a width is shorter than a width of the fourth part in the second direction, and the first head unit and the second head unit are disposed side by side in the second direction such that at least a part of the second part and at least a part of the fifth part do not overlap with each other in the first direction.

DESCRIPTION OF EXEMPLARY EMBODIMENTS

Figure 2:
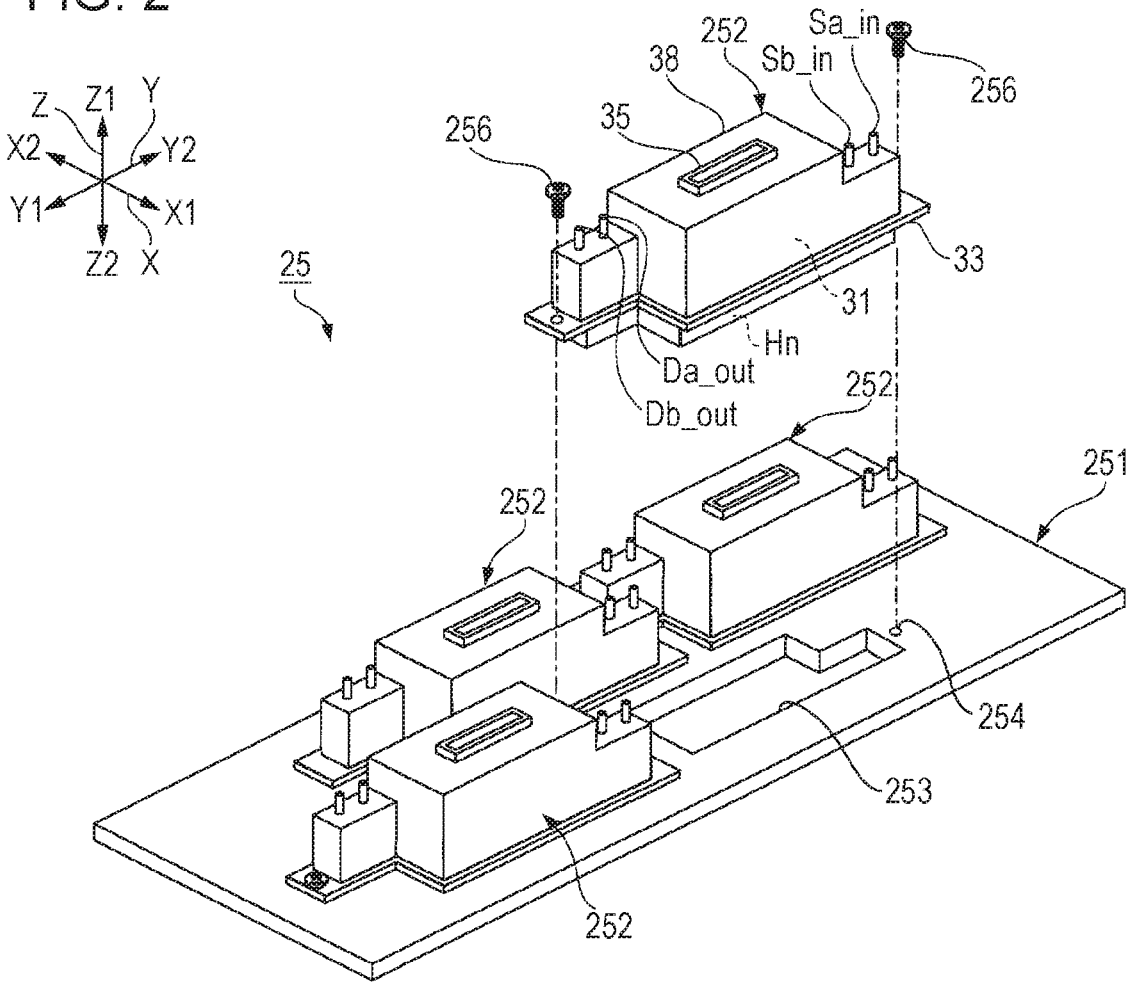
FIG. 2 is a perspective view of a head module.

In the following description, an X axis, a Y axis, and a Z axis that are orthogonal to each other are assumed. As illustrated in FIG. 2, a direction along the X axis when viewed from any point is represented as an X1 direction, and a direction opposite to the X1 direction is represented as an X2 direction. Similarly, directions opposite to each other along the Y axis from any point are represented as Y1 and Y2 directions, and directions opposite to each other along the Z axis from any point are represented as Z1 and Z2 directions. An X-Y plane including the X axis and the Y axis corresponds to a horizontal plane. The Z axis is an axis along the vertical direction, and the Z2 direction corresponds to a lower side in the vertical direction. The X axis, the Y axis, and the Z axis may intersect each other at an angle of approximately 90 degrees.

1. First Embodiment

1-1. Liquid Discharging Apparatus 100

Figure 1:
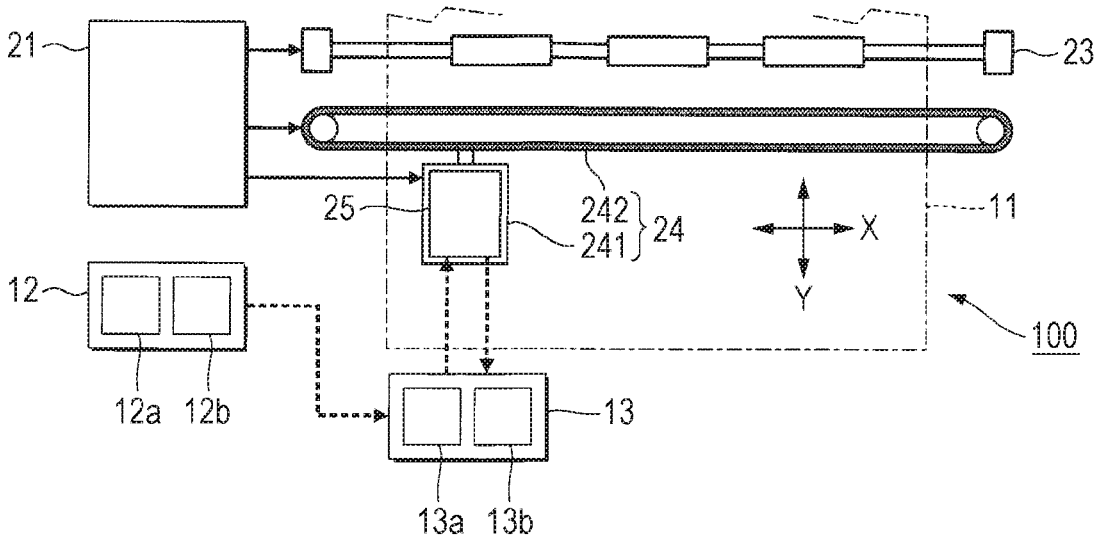
FIG. 1 is a schematic view illustrating a configuration of a liquid discharging apparatus according to a first embodiment.

FIG. 1 is a schematic view illustrating a configuration of a liquid discharging apparatus 100 according to a first embodiment. The liquid discharging apparatus 100 is an ink jet type printing apparatus that discharges ink, which is an example of a liquid, as droplets onto a medium 11 (hereinafter also simply referred to as a recording medium). The medium 11 is typically a printing paper. However, a printing target made of any material such as a resin film or cloth may be used as the medium 11, for example.

As illustrated in FIG. 1, the liquid discharging apparatus 100 is provided with a liquid container 12 that stores the ink. For example, a cartridge that is attachable to and detachable from the liquid discharging apparatus 100, a bag-shaped ink pack made of a flexible film, or an ink tank that can be replenished with ink is used as the liquid container 12. As illustrated in FIG. 1, the liquid container 12 includes a liquid container 12*a* and a liquid container 12*b*. A first ink is stored in the liquid container 12*a*, and a second ink is stored in the liquid container 12*b*. The first ink and the second ink are different types of ink. As an example of the first ink and the second ink, there are cases where the first ink is cyan ink and the second ink is magenta ink.

The liquid discharging apparatus 100 is provided with a sub tank 13 that temporarily stores ink. The ink supplied from the liquid container 12 is stored in the sub tank 13. The sub tank 13 includes a sub tank 13*a* that stores the first ink and a sub tank 13*b* that stores the second ink. The sub tank 13*a* is coupled to the liquid container 12*a*, and the sub tank 13*b* is coupled to the liquid container 12*b*. Further, the sub tank 13 is coupled to a head module 25, supplies ink to the head module 25, and collects the ink from the head module 25. The flow of the ink between the sub tank 13 and the head module 25 will be described in detail later.

As illustrated in FIG. 1, the liquid discharging apparatus 100 includes a control unit 21, a transporting mechanism 23, a moving mechanism 24, and the head module 25. The control unit 21 controls each element of the liquid discharging apparatus 100. The control unit 21 includes, for example, one or a plurality of processing circuits such as a central processing unit (CPU) or a field programmable gate array (FPGA), and one or a plurality of storage circuits such as a semiconductor memory.

The transporting mechanism 23 transports a medium 11 along the Y axis under the control of the control unit 21. The moving mechanism 24 causes the head module 25 reciprocates along the X axis under the control of the control unit 21. The moving mechanism 24 according to the present embodiment includes a substantially box-shaped transporting body 241 that accommodates the head module 25, and an endless belt 242 to which the transporting body 241 is fixed. The liquid container 12 and the sub tank 13 may be mounted on the transporting body 241 together with the head module 25.

The head module 25 discharges the ink which is supplied from the sub tank 13, from each of a plurality of nozzles onto the medium 11 under the control of the control unit 21. The head module 25 discharges the ink onto the medium 11 in parallel with the transport of the medium 11 by the transporting mechanism 23 and the repeated reciprocation of the transporting body 241, thereby an image is formed on a surface of the medium 11.

FIG. 2 is a perspective view of the head module 25. As illustrated in FIG. 2, the head module 25 includes a support body 251 and a plurality of head units 252. The support body 251 is a plate-shaped member that supports the plurality of head units 252. A plurality of mounting holes 253 and a plurality of screw holes 254 are formed in the support body 251. Each head unit 252 is supported by the support body 251 in a state inserted into the mounting hole 253. The plurality of screw holes 254 are provided in twos in correspondence with each of the mounting holes 253. As illustrated in FIG. 2, each head unit 252 is fixed to the support body 251 by screwing using screws 256 and screw holes 254 at two places. The plurality of head units 252 are arranged side by side along the X axis and the Y axis. The arrangement of the plurality of head units 252 will be described later in detail.

1-2. Head Unit 252

Figure 3:
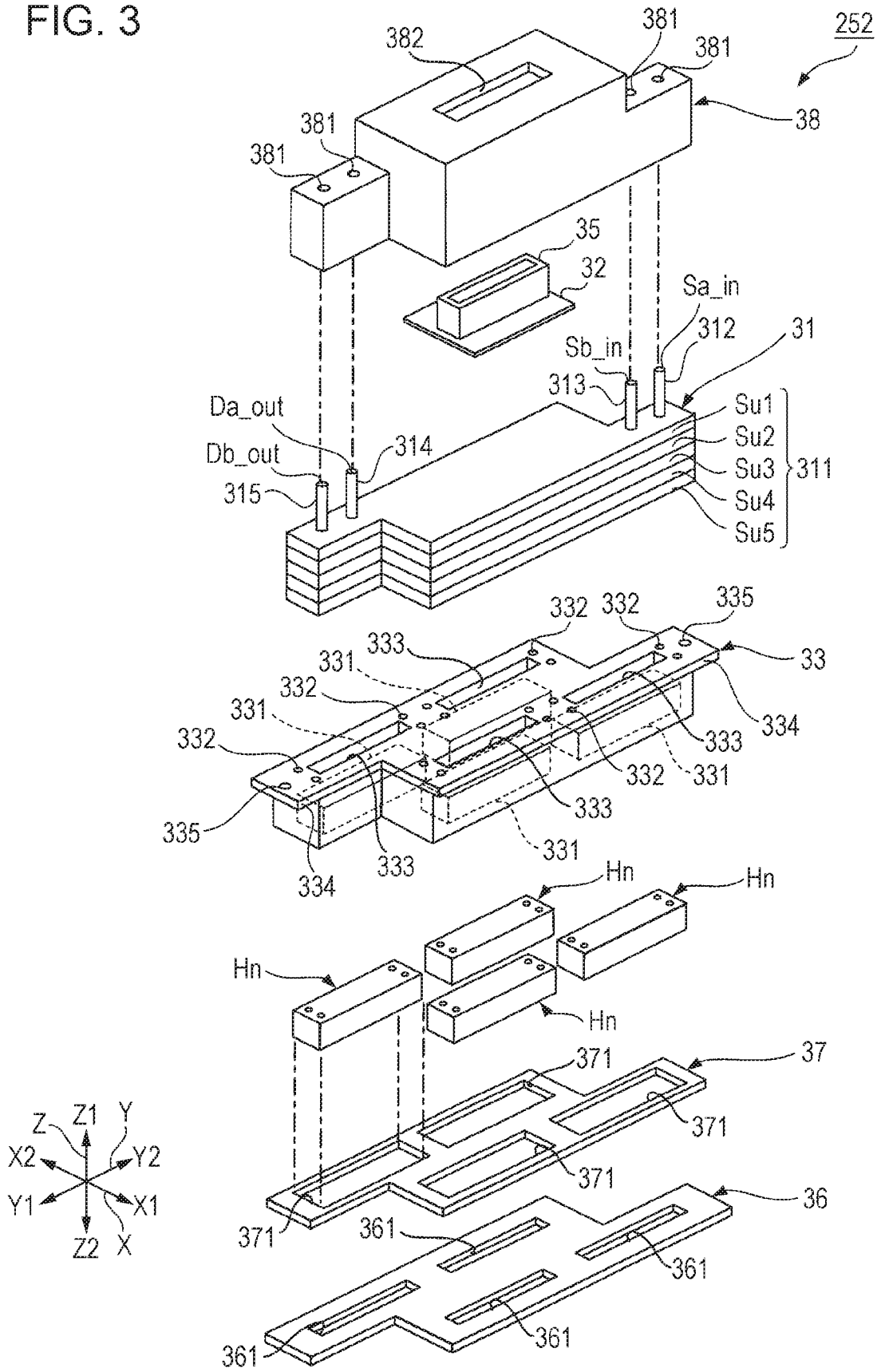
FIG. 3 is a disassembled perspective view of a head unit.

FIG. 3 is a disassembled perspective view of the head unit 252. As illustrated in FIG. 3, the head unit 252 includes a flow path member 31, a wiring substrate 32, a holder 33, a plurality of circulation heads Hn, a fixing plate 36, a reinforcing plate 37, and a cover 38. The flow path member 31 is positioned between the wiring substrate 32 and the holder 33. Specifically, the holder 33 is installed in the Z2 direction with respect to the flow path member 31, and the wiring substrate 32 is installed in the Z1 direction with respect to the flow path member 31. In the present embodiment, the number of circulation heads Hn provided in each head unit 252 is four. In the following, these four circulation heads Hn are also referred to as circulation heads H1, H2, H3, and H4.

The flow path member 31 is a structure having therein a flow path for supplying the ink stored in the sub tank 13 to the plurality of circulation heads Hn. The flow path member 31 includes a flow path structure 311 and coupling pipes 312, 313, 314, and 315. Although not shown in FIG. 3, the flow path structure 311 is provided with a supply flow path for supplying the first ink to the plurality of circulation heads Hn, a supply flow path for supplying the second ink to the plurality of circulation heads Hn, an exhaust flow path for exhausting the first ink from the plurality of circulation heads Hn, and an exhaust flow path for exhausting the second ink from the plurality of circulation heads Hn. The flow path structure 311 is constituted by laminating the plurality of substrates Su1 to Su5. The plurality of substrates Su1 to Su5 constituting the flow path structure 311 are formed by injection molding of a resin material, for example. The plurality of substrates Su1 to Su5 are bonded to each other by, for example, an adhesive. The flow path structure 311 described above has a longitudinal shape along the Y axis. Coupling pipes 312 and 313 are provided in a part at one end of the flow path structure 311 in the longitudinal direction. On the other hand, coupling pipes 314 and 315 are provided in a part at the other end of the flow path structure 311 in the longitudinal direction. Each of the coupling pipes 312, 313, 314, and 315 is a pipe body protruding from the flow path structure 311. The coupling pipe 312 is a supply pipe provided with a supply port Sa_in for supplying the first ink to the flow path structure 311. Similarly, the coupling pipe 313 is a supply pipe provided with a supply port Sb_in for supplying the second ink to the flow path structure 311. On the other hand, the coupling pipe 314 is an exhaust pipe provided with an exhaust port Da_out for exhausting the first ink from the flow path structure 311. Similarly, the coupling pipe 315 is an exhaust pipe provided with an exhaust port Db_out for exhausting the second ink from the flow path structure 311.

The wiring substrate 32 is a mounting component for electrically coupling the head unit 252 to the control unit 21. The wiring substrate 32 is formed of, for example, a flexible wiring substrate, a rigid wiring substrate, or the like. The wiring substrate 32 is disposed on the flow path member 31. One surface of the wiring substrate 32 faces the flow path member 31. A connector 35 is installed on the other surface of the wiring substrate 32. The connector 35 is a coupling component for electrically coupling the head unit 252 and the control unit 21. Further, although not shown, wirings coupled to the plurality of circulation heads Hn are coupled to the wiring substrate 32. The wiring is configured with, for example, a combination of a flexible wiring substrate and a rigid wiring substrate. The wiring may be integrated with the wiring substrate 32.

The holder 33 is a structure that accommodates and supports the plurality of circulation heads Hn. The holder 33 is made of, for example, a resin material or a metal material or the like. The holder 33 is provided with a plurality of recess portions 331, a plurality of ink holes 332, a plurality of wiring holes 333, and a pair of flanges 334. Each of the plurality of recess portions 331 is a space that opens in the Z2 direction and in which the circulation head Hn is disposed. Each of the plurality of ink holes 332 is a flow path through which the ink flows between the circulation head Hn disposed in the recess portion 331 and the flow path member 31 described above. Each of the plurality of wiring holes 333 is a hole through which a wiring (not shown) that couples the circulation head Hn and the wiring substrate 32 is passed. The pair of flanges 334 is fixing portions for fixing the holder 33 to the support body 251. The pair of flanges 334 illustrated in FIG. 3 are provided with holes 335 for screwing to the support body 251. The above-described screw 256 is passed through the hole 335.

Each circulation head Hn discharges the ink. That is, although not shown in FIG. 3, each circulation head Hn has a plurality of nozzles that discharge the first ink and a plurality of nozzles that discharge the second ink. The configuration of the circulation head Hn will be described later.

The fixing plate 36 is a plate member for fixing the plurality of circulation heads Hn to the holder 33. Specifically, the fixing plate 36 is disposed so as to sandwich the plurality of circulation heads Hn with the holder 33, and is fixed to the holder 33 with an adhesive. The fixing plate 36 is made of, for example, a metal material or the like. The fixing plate 36 is provided with a plurality of opening portions 361 for exposing the nozzles of the plurality of circulation heads Hn. In the example of FIG. 3, the plurality of opening portions 361 are individually provided for each circulation head Hn. The opening portion 361 may be shared by two or more circulation heads Hn.

The reinforcing plate 37 is a plate-shaped member that is disposed between the holder 33 and the fixing plate 36 and reinforces the fixing plate 36. The reinforcing plate 37 is arranged on the fixing plate 36 in an overlapping manner and fixed to the fixing plate 36 with an adhesive. The reinforcing plate 37 is provided with a plurality of opening portions 371 in which the plurality of circulation heads Hn are disposed. The reinforcing plate 37 is made of, for example, a metal material or the like. From the viewpoint of reinforcing the fixing plate 36, the thickness of the reinforcing plate 37 is desirably larger than the thickness of the fixing plate 36.

The cover 38 is a box-shaped member that accommodates the flow path structure 311 of the flow path member 31 and the wiring substrate 32. The cover 38 is made of, for example, a resin material or the like. The cover 38 is provided with four through holes 381 and an opening portion 382. The four through holes 381 correspond to the four coupling pipes 312 of the flow path member 31, and a corresponding coupling pipe 312, 313, 314, or 315 is passed through each through hole 381. The connector 35 is passed through the opening portion 382 from the inside of the cover 38 to the outside.

Figure 4:
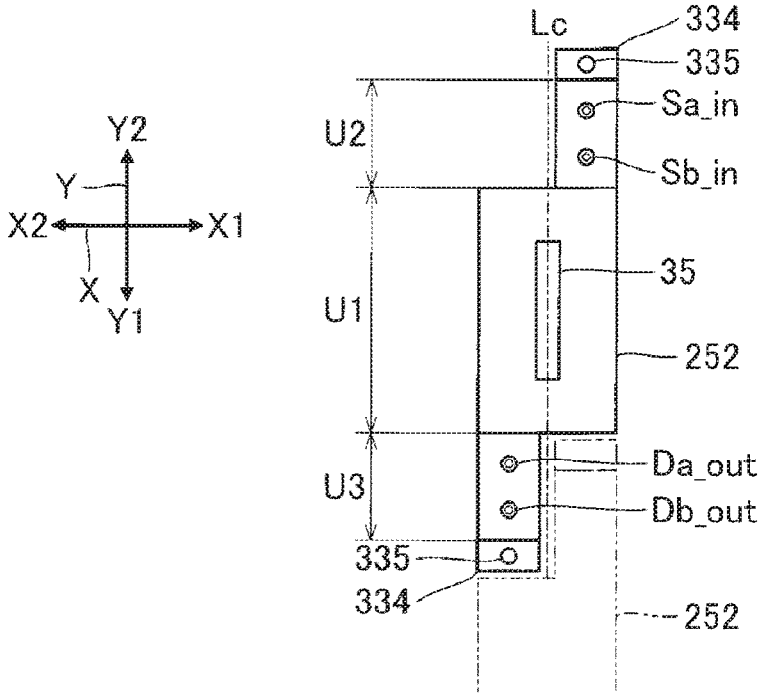
FIG. 4 is a plan view of the head unit as viewed from a Z1 direction.

FIG. 4 is a plan view of the head unit 252 as viewed from the Z1 direction. As illustrated in FIG. 4, each head unit 252 is formed with an outer shape that includes a first part U1, a second part U2, and a third part U3 when viewed from the Z1 direction. The first part U1 is positioned between the second part U2 and the third part U3. Specifically, the second part U2 is positioned in the Y2 direction with respect to the first part U1, and the third part U3 is positioned in the Y1 direction with respect to the first part U1. In the present embodiment, each of the flow path member 31 and the holder 33 is formed with an outer shape corresponding to the head unit 252 when viewed from the Z1 direction. The wiring substrate 32 is formed with an outer shape corresponding to the first part U1 when viewed from the Z1 direction.

In FIG. 4, a center line Lc, which is a line segment passing through a center of the first part U1 along the Y axis, is illustrated. The second part U2 is positioned in the X1 direction with respect to the center line Lc, and the third part U3 is positioned in the X2 direction with respect to the center line Lc. That is, the second part U2 and the third part U3 are positioned on opposite sides of the X axis with the center line Lc interposed therebetween. As illustrated in FIG. 4, the plurality of head units 252 are arranged along the Y axis so that the third part U3 of each head unit 252 and the second part U2 of the other head unit 252 partially overlap with each other along the Y axis.

Figure 5:
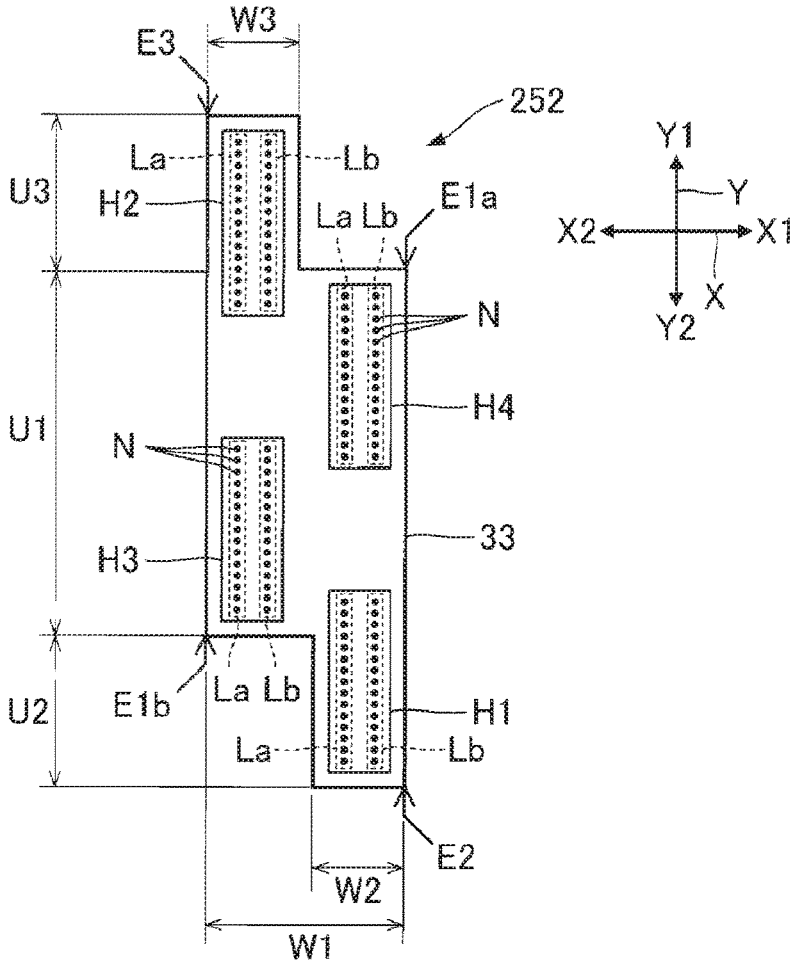
FIG. 5 is a plan view of the head unit as viewed from a Z2 direction.

FIG. 5 is a plan view of the head unit 252 as viewed from the Z2 direction. In FIG. 5 and subsequent figures, the illustration of the pair of flanges 334 is omitted for convenience of description. As illustrated in FIG. 5, the width W2 of the second part U2 along the X axis is shorter than the width W1 of the first part U1 along the X axis. Similarly, the width W3 of the third part U3 along the X axis is shorter than the width W1 of the first part U1 along the X axis. The width W2 and the width W3 illustrated in FIG. 4 are equal to each other. The width W2 and the width W3 may be different from each other. However, when the width W2 and the width W3 are equal to each other, it is possible to increase the symmetry of the shape of the head unit 252, and as a result, there is an advantage that the plurality of head units 252 can be easily arranged densely. The widths W1, W2, and W3 of the first part U1, the second part U2, and the third part U3 are the widths between one end portion and the other end portion along the X axis of each part.

As illustrated in FIG. 5, since the width W2 and the width W3 are shorter than the width W1, the second part U2 and the third part U3 are protruding portions, and the first part U1 can be regarded as the central portion.

An end surface E1*a* of the first part U1 in the X1 direction is a plane continuous with an end surface E2 of the second part U2 in the X1 direction. On the other hand, an end surface E1*b* of the first part U1 in the X2 direction is a plane continuous with an end surface E3 of the third part U3 in the X2 direction. A recess portion or a projection portion may be appropriately provided on these end surfaces. Further, a step may be provided between the end surface E1*a* and the end surface E2, and a step may be provided between the end surface E1*b* and the end surface E3.

As illustrated in FIG. 5, the holder 33 of the head unit 252 holds four circulation heads Hn (n=1 to 4). Each circulation head Hn (n=1 to 4) discharges the ink from a plurality of nozzles N. As illustrated in FIG. 5, the plurality of nozzles N are divided into a nozzle row La and a nozzle row Lb. Each of the nozzle row La and the nozzle row Lb is a set of the plurality of nozzles N arranged along the Y axis. The nozzle row La and the nozzle row Lb are provided side by side with an interval in between in the direction of the X axis. In the following description, the subscript a is added to the reference numeral of the element related to the nozzle row La, and the subscript b is added to the reference numeral of the element related to the nozzle row Lb.

1-3. Circulation Head Hn

Figure 6:
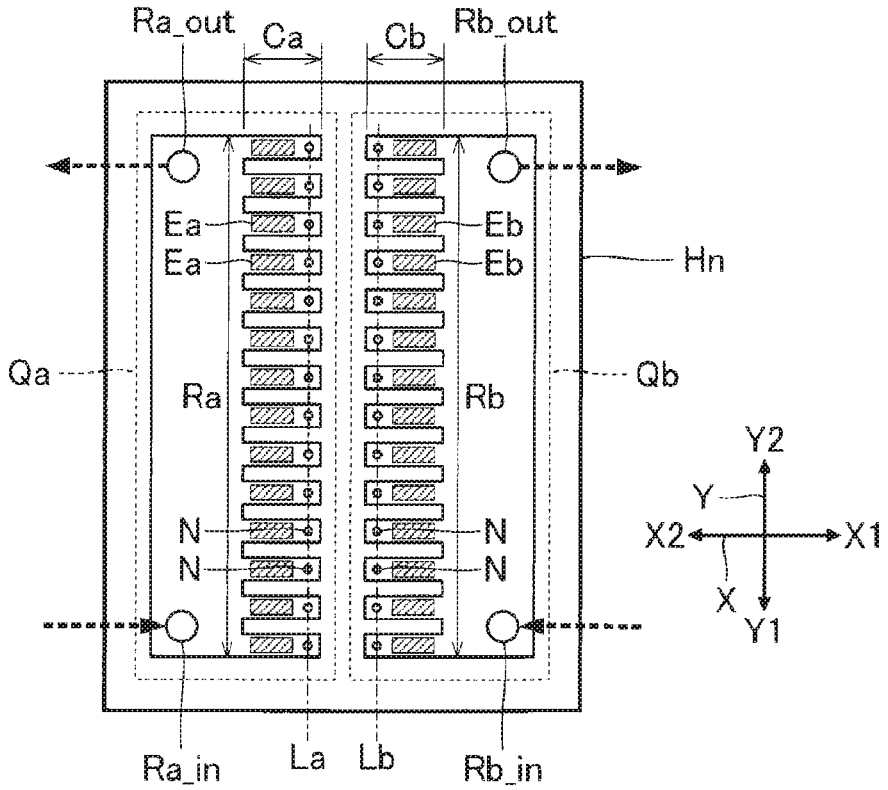
FIG. 6 is a plan view of a head.

FIG. 6 is a plan view of the circulation head Hn. FIG. 6 schematically shows the internal structure of the circulation head Hn viewed from the Z1 direction. As illustrated in FIG. 6, each circulation head Hn includes a liquid discharging portion Qa and a liquid discharging portion Qb. The liquid discharging portion Qa of each circulation head Hn discharges the first ink supplied from the sub tank 13*a* from each nozzle N of the nozzle row La. The liquid discharging portion Qb of each circulation head Hn discharges the second ink supplied from the sub tank 13*b* from each nozzle N of the nozzle row Lb.

The liquid discharging portion Qa includes a liquid storage chamber Ra, a plurality of pressure chambers Ca, and a plurality of driving elements Ea. The liquid storage chamber Ra is a common liquid chamber that is continuous over the plurality of nozzles N of the nozzle row La. The pressure chamber Ca and the driving element Ea are formed for each nozzle N of the nozzle row La. The pressure chamber Ca is a space for communicating with the nozzle N. Each of the plurality of pressure chambers Ca is filled with the first ink supplied from the liquid storage chamber Ra. The driving element Ea changes the pressure of the first ink inside the pressure chamber Ca. For example, a piezoelectric element that changes the volume of the pressure chamber Ca by deforming the wall surface of the pressure chamber Ca or a heat generating element that generates bubbles inside the pressure chamber Ca by heating the first ink inside the pressure chamber Ca is desirably utilized as the driving element Ea. The driving element Ea changes the pressure of the first ink in the pressure chamber Ca, and thus the first ink inside the pressure chamber Ca is discharged from the nozzle N.

The liquid discharging portion Qb includes a liquid storage chamber Rb, a plurality of pressure chambers Cb, and a plurality of driving elements Eb, like the liquid discharging portion Qa. The liquid storage chamber Rb is a common liquid chamber that is continuous over the plurality of nozzles N of the nozzle row Lb. The pressure chamber Cb and the driving element Eb are formed for each nozzle N of the nozzle row Lb. Each of the plurality of pressure chambers Cb is filled with the second ink supplied from the liquid storage chamber Rb. The driving element Eb is, for example, the above-described piezoelectric element or heat generating element. The driving element Eb changes the pressure of the second ink inside the pressure chamber Cb, and thus the second ink inside the pressure chamber Cb is discharged from the nozzle N.

As illustrated in FIG. 6, each circulation head Hn is provided with a supply port Ra_in, an exhaust port Ra_out, a supply port Rb_in, and an exhaust port Rb_out. The supply port Ra_in and the exhaust port Ra_out communicate with the liquid storage chamber Ra. The supply port Rb_in and the exhaust port Rb_out communicate with the liquid storage chamber Rb.

The first ink, among the first ink stored in the liquid storage chamber Ra of each circulation head Hn described above, that is not discharged from each nozzle N of the nozzle row La circulates in the path of the exhaust port Ra_out→the exhaust flow path for the first ink of the flow path member 31→the sub tank 13*a* provided outside the head unit 252→the supply flow path for the first ink of the flow path member 31→the supply port Ra_in→the liquid storage chamber Ra. Similarly, the second ink, among the second ink stored in the liquid storage chamber Rb of each circulation head Hn, that is not discharged from each nozzle N of the nozzle row Lb circulates in the path of the exhaust port Rb_out→the exhaust flow path for the second ink of the flow path member 31→the sub tank 13*b* provided outside the head unit 252→the supply flow path for the second ink of the flow path member 31→the supply port Rb_in→the liquid storage chamber Rb.

1-4. Discharging Amount from Head Unit 252

Figure 7:
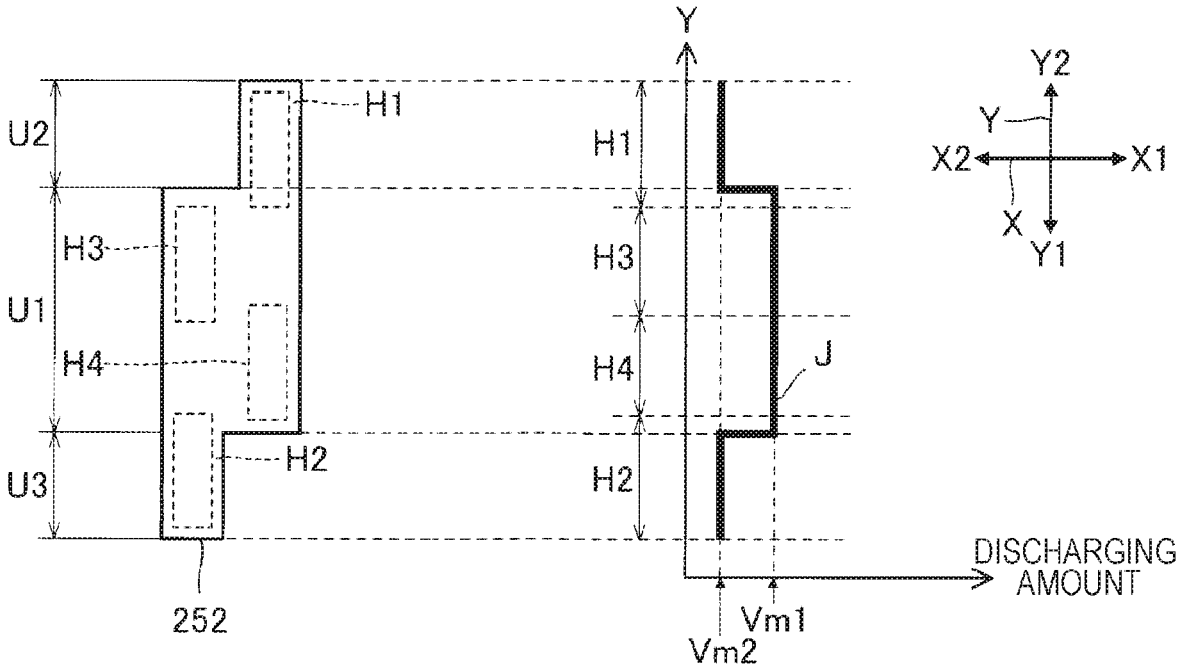
FIG. 7 is a diagram illustrating a relationship between a position on the Y axis and a discharging amount of a liquid for the head unit.

FIG. 7 is a diagram illustrating a relationship between a position on the Y axis and a discharging amount of ink for the head unit 252. In the following description, when referring to the discharging amount of the ink, it is assumed that a certain one and the same drive signal is input, unless otherwise specified. Further, as illustrated in FIG. 5 and the like, actually, the plurality of nozzles N at an end portion of the circulation head Hn adjacent to the Y axis (for example, the plurality of nozzles N at the end of the circulation head H1 in the Y1 direction and the plurality of nozzles N at the end of the circulation head H3 in the Y2 direction) are provided so as to overlap with the Y axis (positioned at the same position on the Y axis), but for the simplicity, the following description will be given assuming that these nozzles do not overlap with the Y axis.

As indicated in the change J of the discharging amount of the ink illustrated in FIG. 7, the discharging amount Vm1 from the nozzle N provided in the first part U1 is larger than the discharge amount Vm2 from the nozzle N provided in the second part U2 and the third part U3. The reason why the difference in discharging amount appears is considered as follows. The temperature of the ink in the second part U2 and the third part U3 becomes lower than the temperature of the ink in the first part U1 for the reason described later. As the temperature of the ink decreases, the viscosity of the ink generally increases. As a result, even when the same drive signal is input and the same amount of energy is applied to the ink, the discharging amount decreases as the ink viscosity increases.

The following reasons can be considered as the reason why the temperature of the ink decreases. The second part U2 and the third part U3, as compared with the first part U1, have smaller members and thus have a smaller heat capacity, and thus are easily cooled to a lower temperature. Further, since the second part U2 and the third part U3 have larger distances with other members in the X1 direction or the X2 direction, as compared with the first part U1 in the X1 direction or the X2 direction, the heat dissipation easily occurs. Further, especially when the support body 251 is made of a metal material, due to the high heat conductivity of the metal, the second part U2 and the third part U3 having smaller heat capacity are easily cooled to a lower temperature.

As illustrated in FIG. 7, the circulation head H1 is positioned in the head unit 252 in the X1 direction or the Y2 direction. The circulation head H2 is positioned in the head unit 252 in the X2 direction or the Y1 direction. The circulation head H3 is positioned in the head unit 252 in the X2 direction or the Y2 direction. The circulation head H4 is positioned in the head unit 252 in the X1 direction or the Y1 direction.

A part of the circulation head H1 is positioned in the second part U2 and the other part is positioned in the first part U1. Therefore, regarding the discharging amount of the circulation head H1, the discharging amount from the nozzle N provided in the second part U2 is Vm2, which is smaller than Vm1 that is the discharging amount from the nozzle N provided in the first part U1. Similarly, a part of the circulation head H2 is positioned in the third part U3 and the other part is positioned in the first part U1. Therefore, regarding the discharging amount of the circulation head H2, the discharging amount from the nozzle N provided in the third part U3 is Vm2, which is smaller than Vm1 that is the discharging amount from the nozzle N provided in the first part U1. Since all of the circulation heads H3 and H4 are positioned in the first part U1, the discharging amount of all the nozzles N is relatively large as Vm1. The discharging amount from the nozzle N provided in the circulation head Hn is not always constant regardless of the position in the circulation head Hn as illustrated in FIG. 7. For example, the discharging amount of the nozzles N provided in the second part U2 may monotonously decrease according to the distance from the first part U1.

The density of the image recorded on the recording medium increases in proportion to the discharging amount of the ink from the nozzle N. That is, when the discharging amount of a certain nozzle N is large, the density of the image recorded in a region on the recording medium corresponding to the nozzle N is large, and when the discharging amount is small, the image density is small. Therefore, when the ink is discharged from all the nozzles N of the head unit 252, the same unevenness in density as the change J in the discharging amount in FIG. 7 occurs on the Y axis. However, when only the head unit 252 is used, the difference in discharging amount between the regions adjacent to each other on the Y axis is a relatively small value of Vm1−Vm2 at the boundary between the second part U2 and the first part U1, and at the boundary between the first part U1 and the third part U3. Further, when viewed from the entire Y axis, the maximum discharging amount is Vm1 and the minimum is Vm2, which is small. Therefore, in the image recorded on the recording medium, since both the local difference in density and the overall unevenness in density occur only in small amounts, the image quality is less likely to deteriorate.

1-5. Disposition Form of Head Unit 252

Figure 8:
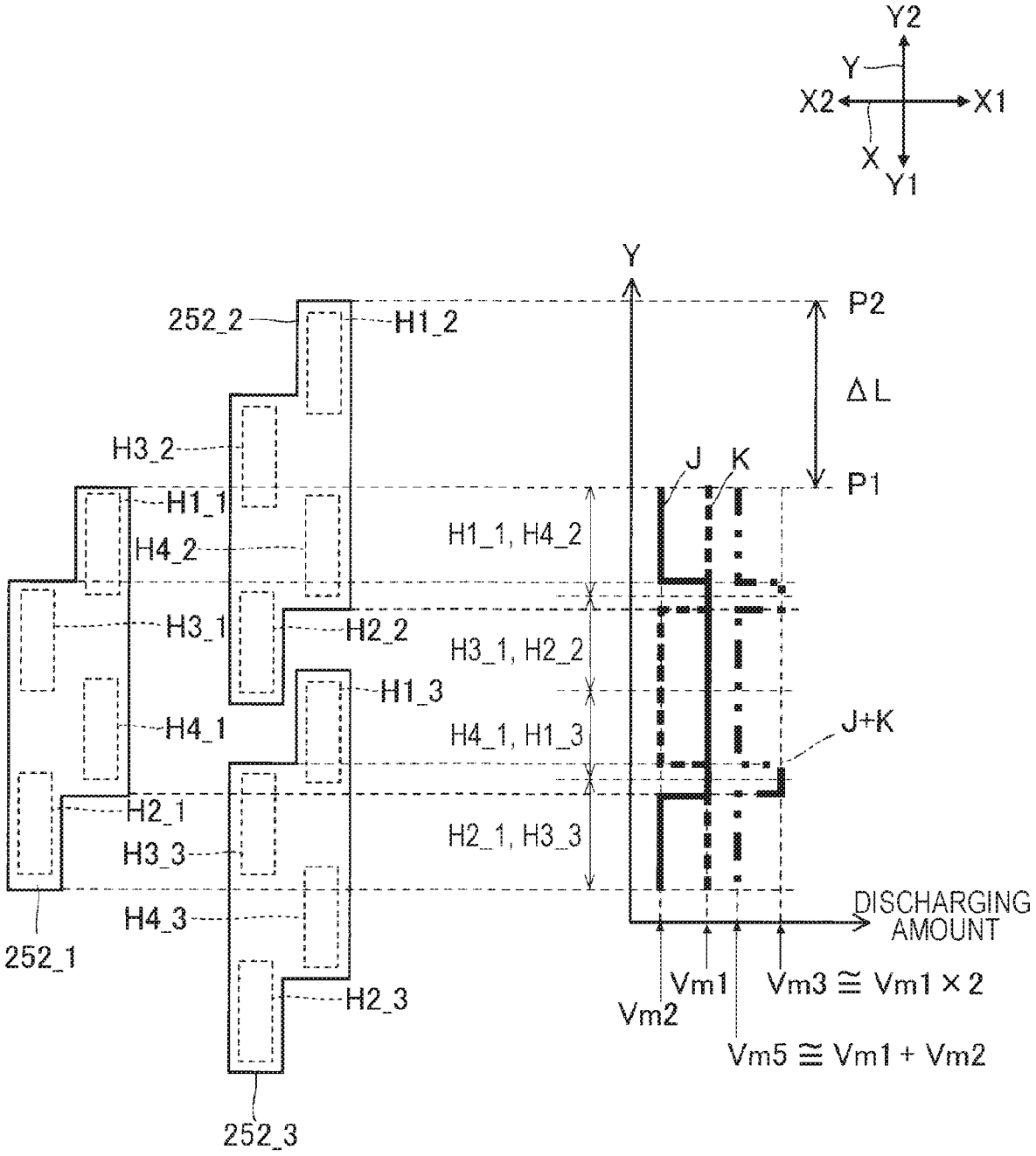
FIG. 8 is a diagram illustrating a relationship between a first disposition form of the head units and the discharging amounts of ink.
Figure 9:
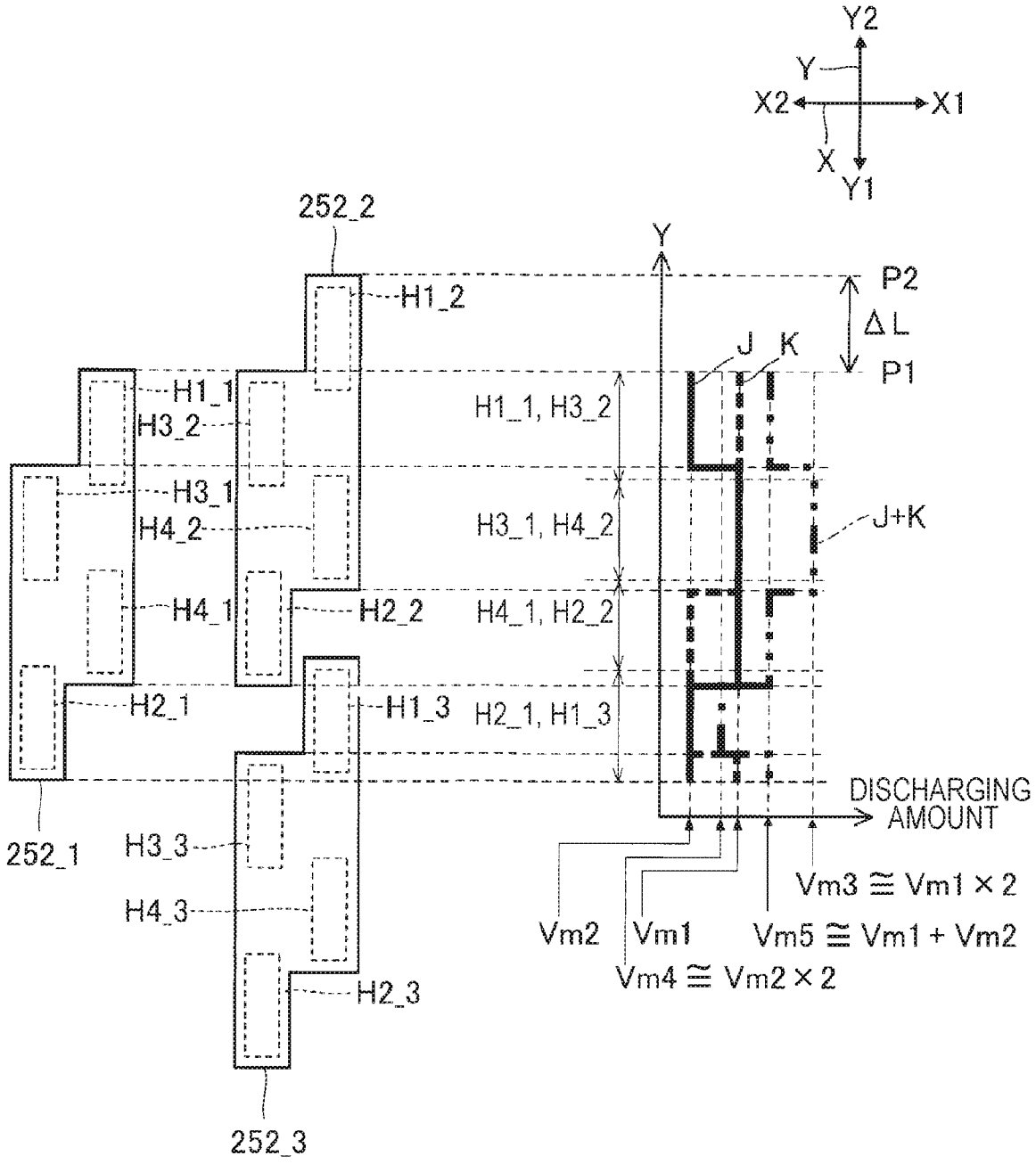
FIG. 9 is a diagram illustrating a relationship between a second disposition form of the head units and the discharging amounts of the ink.
Figure 10:
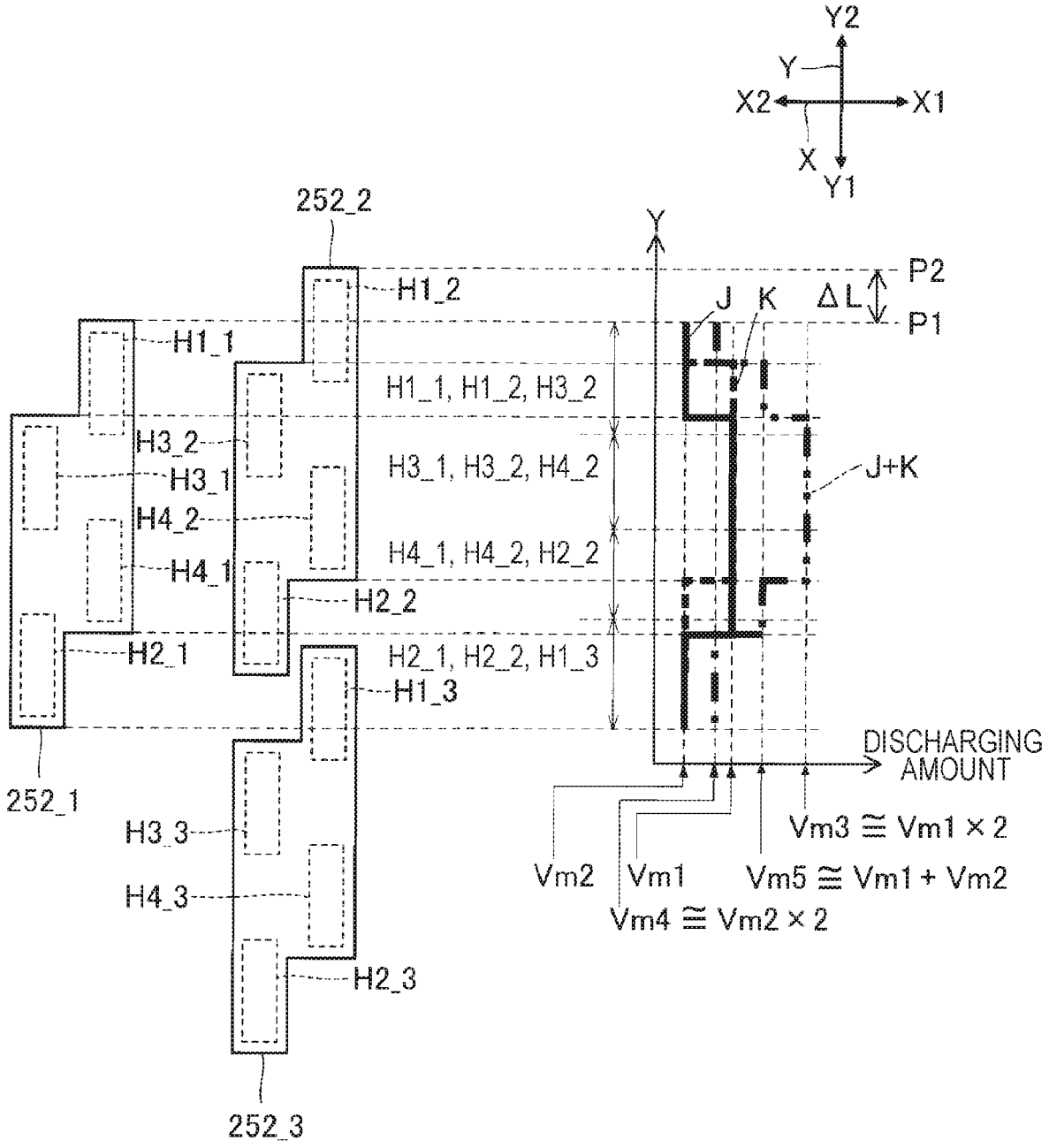
FIG. 10 is a diagram illustrating a relationship between a third disposition form of the head units and the discharging amounts of the ink.

When each of the second parts U2 of the circulation head Hn is disposed at the same position on the Y axis along the X axis in one head unit 252 and the other head units 252, the image quality deterioration due to the change in the discharging amount in the head unit becomes remarkable. Therefore, in the first embodiment, at least a part of each second part U2 of the circulation head Hn is disposed side by side in the X1 direction or the X2 direction so that they do not overlap in the Y1 direction or the Y2 direction. As the dispositions of the head units 252 in which at least a part of each second part U2 of circulation head Hn does not overlap in the Y1 direction or the Y2 direction, for example, there are three forms illustrated in FIGS. 8 to 10. In FIGS. 8 to 10, among the plurality of head units 252 supported by the support body 251, the head unit 252_1, the head unit 252_2, and the head unit 252_3 are illustrated as representatives.

In the following description, the circulation heads Hn included in the head unit 252_*i* is also referred to as circulation heads H1_*i*, H2_*i*, H3_*i*, and H4_*i*. i is one of 1, 2, and 3.

1-6. Reference Example

Figure 11:
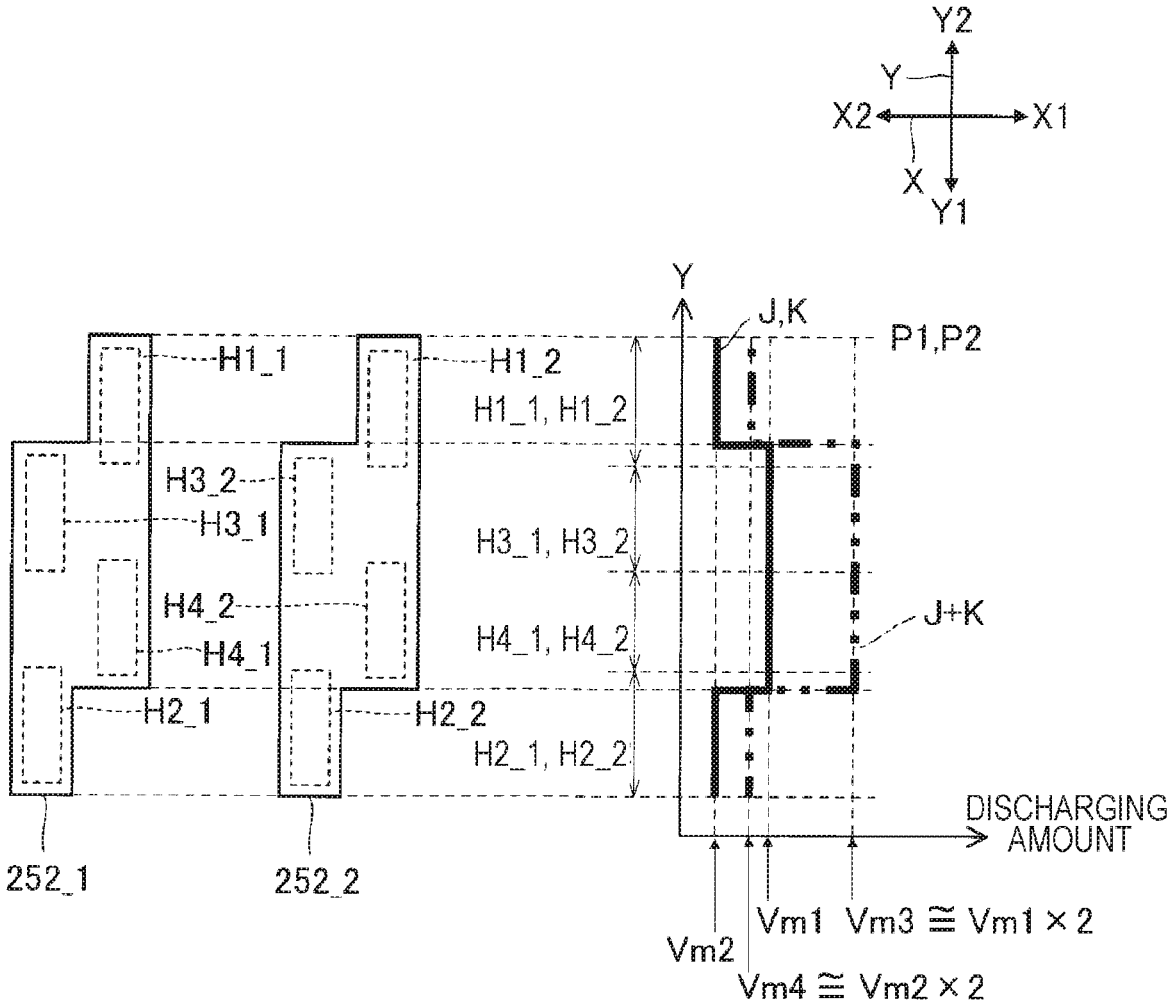
FIG. 11 is a diagram illustrating the relationship between a disposition form of the head units and the discharging amounts of the ink in the reference example.

FIG. 11 is a diagram illustrating the relationship between a disposition form of the head units 252 and the discharging amounts of the ink in the reference example. As illustrated in FIG. 11, in the reference example, the position P1 of the head unit 252_1 and the position P2 of the head unit 252_2 on the Y axis coincide with each other.

FIG. 11 illustrates a change J in the discharging amount of the ink from each nozzle N of the head unit 252_1 on the Y axis and a change K in the discharging amount of the ink from each nozzle N of the head unit 252_2 on the Y axis. Further, FIG. 11 illustrates the change J+K in the total discharging amount from each nozzle of the discharging amount from the head unit 252_1 and the discharging amount from the head unit 252_2 on the Y axis.

The change J in the discharging amount will be described. From the Y2 side to the Y1 side, the discharging amount is Vm2 at the beginning, the discharging amount is Vm1 (>Vm2) from the boundary between the second part U2 and the first part U1 of the head unit 252_1, and the discharging amount is Vm2 from the boundary between the first part U1 and the third part U3 of the head unit 252_1.

The change K in the discharging amount will be described. From the Y2 side to the Y1 side, the discharging amount is Vm2 at the beginning, the discharging amount is Vm1 (>Vm2) from the boundary between the second part U2 and the first part U1 of the head unit 252_2, and the discharging amount is Vm2 from the boundary between the first part U1 and the third part U3 of the head unit 252_2.

As described above, in the reference example, the position P1 of the head unit 252_1 and the position P2 of the head unit 252_2 on the Y axis coincide with each other. Therefore, the change J+K in the total discharging amount is the sum of the change K in the discharging amount and the change J in the discharging amount.

The change J+K in the total discharging amount will be described. From the Y2 side to the Y1 side, the discharging amount is Vm4≅Vm2×2 at the beginning. This region is because the second part U2 (discharging amount=Vm2) of the head unit 252_1 and the second part U2 (discharging amount=Vm2) of the head unit 252_2 correspond to each other.

Next, the discharging amount is Vm3≅Vm1×2 from the boundary between the second part U2 and the first part U1 of the head unit 252_1 (the same position as the boundary between the second part U2 and the first part U1 of the head unit 252_2 on the Y axis). This region is because the first part U1 (discharging amount=Vm1) of the head unit 252_1 and the first part U1 (discharging amount=Vm1) of the head unit 252_2 correspond to each other.

The discharging amount is Vm4≅Vm2×2 from the boundary between the first part U1 and the third part U3 of the head unit 252_1 (the same position as the boundary between the first part U1 and the third part U3 of the head unit 252_2 on the Y axis). This region is because the third part U3 (discharging amount=Vm2) of the head unit 252_1 and the third part U3 (discharging amount=Vm2) of the head unit 252_2 correspond to each other.

As a result, in the reference example, the difference in the discharging amount between the regions adjacent to each other on the Y axis becomes a large value of Vm3−Vm4≅2×(Vm1−Vm2), at the boundary between the second part U2 and the first part U1 of the head unit 252_1 and the boundary between the first part U1 and the third part U3 of the head unit 252_1. When the difference in the discharging amount itself is small, or when the discharging amount changes stepwise with a certain width on the Y axis, the image quality due to the difference in the discharging amount is hardly recognized. However, when a steep and large difference in the discharging amount occurs along the Y axis as in the reference example, the local difference in density (density gap) in the recording image becomes large, and the image quality deteriorates significantly.

Further, in the reference example, when viewed on the entire Y axis, the maximum discharging amount is Vm3≅2×Vm1, the minimum is Vm4≅2×Vm2, and the difference becomes a large value of 2×(Vm1−Vm2). Even when only a slight difference in the discharging amount occurs along the Y axis, if the difference between the maximum value and the minimum value of the discharging amounts is too large as in the reference example, the overall unevenness in density is visually recognized when the recorded image is viewed macroscopically (macro), and the image quality may be deteriorated.

As described above, in the reference example, the image quality may be deteriorated due to the local difference in density or the overall unevenness in density.

1-7-1. First Disposition Form of Head Unit 252

FIG. 8 is a diagram illustrating a relationship between a first disposition form of the head units 252 and the discharging amounts of ink. In the first disposition form, the head unit 252_1 and the head unit 252_2 are disposed at positions shifted from the Y axis. More specifically, the shifting ΔL between the position P1 of the head unit 252_1 and the position P2 of the head unit 252_2 on the Y axis is approximately twice the length of the circulation head Hn on the Y axis.

Since the shifting ΔL is twice the length of the circulation head Hn on the Y axis, the circulation head H4_2 corresponds to the region on the medium 11 to which the circulation head H1_1 corresponds, the circulation head H3_3 corresponds to the region on the medium 11 to which the circulation head H2_1 corresponds, the circulation head H2_2 corresponds to the region on the medium 11 to which the circulation head H3_1 corresponds, and the circulation head H1_3 corresponds to the region on the medium 11 to which the circulation head H4_1 corresponds.

FIG. 8 illustrates a change J in the discharging amount of the ink from each nozzle N of the head unit 252_1 on the Y axis and a change K in the discharging amount of the ink from each nozzle N of a part of the head unit 252_2 and a part of the head unit 252_3 on the Y axis, respectively. Further, FIG. 9 illustrates the change J+K in the total discharging amount from each nozzle N of the discharging amount from the head unit 252_1 and the discharging amount from a part of the head unit 252_2 and a part of the head unit 252_3 on the Y axis. The discharging amount of the ink shown below will be described at positions that overlap with the head unit 252_1 on the Y axis, and the description of positions that do not overlap with the head unit 252_1 will be omitted.

The change J in the discharging amount will be described. From the Y2 side to the Y1 side, the discharging amount is Vm2 at the beginning, the discharging amount is Vm1 (>Vm2) from the boundary between the second part U2 and the first part U1 of the head unit 252_1, and the discharging amount is Vm2 from the boundary between the first part U1 and the third part U3 of the head unit 252_1. The change J in the discharging amount in the first disposition form is the same as the change J in the discharging amount in the reference example.

The change K in the discharging amount will be described. From the Y2 side to the Y1 side, the discharging amount is Vm1 at the beginning, the discharging amount is Vm2 (<Vm1) from the boundary between the first part U1 and the third part U3 of the head unit 252_2, and the discharging amount is Vm1 from the boundary between the second part U2 and the first part U1 of the head unit 252_3.

The change J+K in the total discharging amount will be described. From the Y2 side to the Y1 side, the discharging amount is Vm5≅Vm1+Vm2 at the beginning. This region is because the second part U2 (discharging amount=Vm2) of the head unit 252_1 and the first part U1 (discharging amount=Vm1) of the head unit 252_2 correspond to each other.

Next, the discharging amount is Vm3≅Vm1×2 from the boundary between the second part U2 and the first part U1 of the head unit 252_1. This region is because the first part U1 (discharging amount=Vm1) of the head unit 252_1 and the first part U1 (discharging amount=Vm1) of the head unit 252_2 correspond to each other.

Next, the discharging amount is Vm5≅Vm1+Vm2 from the boundary between the first part U1 and the third part U3 of the head unit 252_2. This region is because the first part U1 (discharging amount=Vm1) of the head unit 252_1 and the third part U3 (discharging amount=Vm2) of the head unit 252_2 correspond to each other, or the first part U1 (discharging amount=Vm1) of the head unit 252_1 and the second part U2 (discharging amount=Vm2) of the head unit 252_3 correspond to each other.

Next, the discharging amount is Vm3≅Vm1×2 from the boundary between the second part U2 and the first part U1 of the head unit 252_3. This region is because the first part U1 (discharging amount=Vm1) of the head unit 252_1 and the first part U1 (discharging amount=Vm1) of the head unit 252_3 correspond to each other.

The discharging amount is Vm5≅Vm1+Vm2 from the boundary between the first part U1 and the third part U3 of the head unit 252_1. This region is because the third part U3 (discharging amount=Vm2) of the head unit 252_1 and the first part U1 (discharging amount=Vm1) of the head unit 252_3 correspond to each other.

As a result, in the first disposition form, the difference in the discharging amount between the regions adjacent to each other on the Y axis is Vm3−Vm5≅Vm1−Vm2, at the four boundaries of (1) the boundary between the second part U2 and the first part U1 of the head unit 252_1, (2) the boundary between the first part U1 and the third part U3 of the head unit 252_2, (3) the boundary between the second part U2 and the first part U1 of the head unit 252_3, and (4) the boundary between the first part U1 and the third part U3 of the head unit 252_1.

On the other hand, as described above, in the reference example, the difference in the discharging amount between the regions adjacent to each other on the Y axis is 2×(Vm1−Vm2). When comparing the first disposition form with the reference example, it is expressed such that Vm1−Vm2<2×(Vm1−Vm2), and thus the difference in the discharging amount of the first disposition form is smaller than that of the reference example by Vm1−Vm2. Therefore, the local difference in density can be reduced in the image recorded on the recording medium.

Further, in the first disposition form, when viewed on the entire Y axis, the maximum discharging amount is Vm3≅2×Vm1, the minimum is Vm5≅Vm1+Vm2, and the difference is Vm1−Vm2.

On the other hand, as described above, in the reference example, the maximum discharging amount on the entire Y axis is Vm3≅2×Vm1, the minimum is Vm4≅2×Vm2, and the difference is 2×(Vm1−Vm2). When comparing the first disposition form with the reference example, it is expressed such that Vm1−Vm2<2×(Vm1−Vm2), and thus the difference between the maximum and minimum in the discharging amount of the first disposition form is smaller than that of the reference example by Vm1−Vm2 on the entire Y axis. Therefore, it is possible to reduce the overall unevenness in density in the image recorded on the recording medium.

As described above, according to the first disposition form, it is possible to reduce both the local difference in density and the overall unevenness in density, and suppress the deterioration in image quality.

1-7-2. Second Disposition Form of Head Unit 252

FIG. 9 is a diagram illustrating a relationship between a second disposition form of the head units 252 and the discharging amounts of ink. In the second disposition form, the head unit 252_1 and the head unit 252_2 are also disposed at positions shifted from the Y axis. More specifically, the shifting ΔL between the position P1 of the head unit 252_1 and the position P2 of the head unit 252_2 on the Y axis substantially coincides with the length of the circulation head Hn on the Y axis.

Since the shifting ΔL coincides with the length of the circulation head Hn on the Y axis, the circulation head H3_2 corresponds to the region on the medium 11 to which the circulation head H1_1 corresponds, the circulation head H1_3 corresponds to the region on the medium 11 to which the circulation head H2_1 corresponds, the circulation head H4_2 corresponds to the region on the medium 11 to which the circulation head H3_1 corresponds, and the circulation head H2_2 corresponds to the region on the medium 11 to which the circulation head H4_1 corresponds.

FIG. 9 illustrates a change J in the discharging amount of the ink from each nozzle N of the head unit 252_1 on the Y axis and a change K in the discharging amount of the ink from each nozzle N of a part of the head unit 252_2 and a part of the head unit 252_3 on the Y axis, respectively. Further, FIG. 10 illustrates the change J+K in the total discharging amount from each nozzle N of the discharging amount from the head unit 252_1 and the discharging amount from a part of the head unit 252_2 and a part of the head unit 252_3 on the Y axis. The discharging amount of the ink shown below will be described at positions that overlap with the head unit 252_1 on the Y axis, and the description of positions that do not overlap with the head unit 252_1 will be omitted.

The change J in the discharging amount will be described. From the Y2 side to the Y1 side, the discharging amount is Vm2 at the beginning, the discharging amount is Vm1 (>Vm2) from the boundary between the second part U2 and the first part U1 of the head unit 252_1, and the discharging amount is Vm2 from the boundary between the first part U1 and the third part U3 of the head unit 252_1. The change J in the discharging amount in the second disposition form is the same as the change J in the discharging amount in the first disposition form and the reference example.

The change K in the discharging amount will be described. From the Y2 side to the Y1 side, the discharging amount is Vm1 at the beginning, the discharging amount is Vm2 (<Vm1) from the boundary between the first part U1 and the third part U3 of the head unit 252_2, and the discharging amount is Vm1 from the boundary between the second part U2 and the first part U1 of the head unit 252_3.

The change J+K in the total discharging amount will be described. From the Y2 side to the Y1 side, the discharging amount is Vm5≅Vm1+Vm2 at the beginning. This region is because the second part U2 (discharging amount=Vm2) of the head unit 252_1 and the first part U1 (discharging amount=Vm1) of the head unit 252_2 correspond to each other.

Next, the discharging amount is Vm3 Vm1×2 from the boundary between the second part U2 and the first part U1 of the head unit 252_1. This region is because the first part U1 (discharging amount=Vm1) of the head unit 252_1 and the first part U1 (discharging amount=Vm1) of the head unit 252_2 correspond to each other.

Next, the discharging amount is Vm5≅Vm1+Vm2 from the boundary between the first part U1 and the third part U3 of the head unit 252_2. This region is because the first part U1 (discharging amount=Vm1) of the head unit 252_1 and the third part U3 (discharging amount=Vm2) of the head unit 252_2 correspond to each other, or the first part U1 (discharging amount=Vm1) of the head unit 252_1 and the second part U2 (discharging amount=Vm2) of the head unit 252_3 correspond to each other.

Next, the discharging amount is Vm4 Vm2×2 from the boundary between the first part U1 and the third part U3 of the head unit 252_1. This region is because the third part U3 (discharging amount=Vm2) of the head unit 252_1 and the second part U2 (discharging amount=Vm2) of the head unit 252_3 correspond to each other.

The discharging amount is Vm5≅Vm1+Vm2 from the boundary between the second part U2 and the first part U1 of the head unit 252_3. This region is because the third part U3 (discharging amount=Vm2) of the head unit 252_1 and the first part U1 (discharging amount=Vm1) of the head unit 252_3 correspond to each other.

As a result, in the second disposition form, the difference in the discharging amount between the regions adjacent to each other on the Y axis is Vm3−Vm5≅Vm1−Vm2, at the two boundaries of (1) the boundary between the second part U2 and the first part U1 of the head unit 252_1, (2) the boundary between the first part U1 and the third part U3 of the head unit 252_2.

Further, in the second disposition form, the difference in the discharging amount between the regions adjacent to each other on the Y axis is Vm5−Vm4≅Vm1−Vm2, at the two boundaries of (3) the boundary between the first part U1 and the third part U3 of the head unit 252_1, and (4) the boundary between the second part U2 and the first part U1 of the head unit 252_3. That is, the difference in discharging amount becomes Vm1−Vm2 at the four boundaries.

On the other hand, as described above, in the reference example, the difference in the discharging amount between the regions adjacent to each other on the Y axis is 2×(Vm1−Vm2). When comparing the second disposition form with the reference example, it is expressed such that Vm1−Vm2<2×(Vm1−Vm2), and thus the difference in the discharging amount of the second disposition form is smaller than that of the reference example by Vm1−Vm2. Therefore, the local difference in density can be reduced in the image recorded on the recording medium.

As described above, according to the second disposition form, it is possible to reduce the local difference in density and suppress the deterioration of the image quality.

1-7-3. Third Disposition Form of Head Unit 252

FIG. 10 is a diagram illustrating a relationship between a third disposition form of the head units 252 and the discharging amounts of ink. In the third disposition form, the head unit 252_1 and the head unit 252_2 are also disposed at positions shifted from the Y axis. More specifically, the shifting ΔL between the position P1 of the head unit 252_1 and the position P2 of the head unit 252_2 on the Y axis is approximately 0.5 times the length of the circulation head Hn in the Y1 direction or the Y2 direction.

Since the shifting ΔL is 0.5 times the length of the circulation head Hn in the Y1 direction or the Y2 direction, the circulation head H3_2 corresponds to the region in the Y1 direction, and the circulation head H1_2 corresponds to the region in the Y2 direction, among the region on the medium 11 to which the circulation head H1_1 corresponds. The circulation head H1_3 corresponds to the region in the Y1 direction, and the circulation head H2_2 corresponds to the region in the Y2 direction, among the region on the medium 11 to which the circulation head H2_1 corresponds. The circulation head H4_2 corresponds to the region in the Y1 direction, and the circulation head H3_2 corresponds to the region in the Y2 direction, among the region on the medium 11 to which the circulation head H3_1 corresponds. The circulation head H2_2 corresponds to the region in the Y1 direction, and the circulation head H4_2 corresponds to the region in the Y2 direction, among the region on the medium 11 to which the circulation head H4_1 corresponds.

FIG. 10 illustrates a change J in the discharging amount of the ink from each nozzle of the head unit 252_1 on the Y axis and a change K in the discharging amount of the ink from each nozzle of a part of the head unit 252_2 and a part of the head unit 252_3 on the Y axis, respectively. Further, FIG. 10 illustrates the change J+K in the total discharging amount from each nozzle of the discharging amount from the head unit 252_1 and the discharging amount from a part of the head unit 252_2 and the head unit 252_3 on the Y axis. The discharging amount of the ink shown below will be described at positions that overlap with the head unit 252_1 on the Y axis, and the description of positions that do not overlap with the head unit 252_1 will be omitted.

The change J in the discharging amount will be described. From the Y2 side to the Y1 side, the discharging amount is Vm2 at the beginning, the discharging amount is Vm1 (>Vm2) from the boundary between the second part U2 and the first part U1 of the head unit 252_1, and the discharging amount is Vm2 from the boundary between the first part U1 and the third part U3 of the head unit 252_1. The change J in the discharging amount in the third disposition form is the same as the change J in the discharging amount in the first disposition form, the second disposition form, and the reference example.

The change K in the discharging amount will be described. From the Y2 side to the Y1 side, the discharging amount is Vm2 at the beginning, the discharging amount is Vm1 (>Vm2) from the boundary between the first part U1 and the third part U3 of the head unit 252_2, and the discharging amount is Vm2 from the boundary between the second part U2 and the first part U1 of the head unit 252_3.

The change J+K in the total discharging amount will be described. From the Y2 side to the Y1 side, the discharging amount is Vm4≅2×Vm2 at the beginning. This region is because the second part U2 (discharging amount=Vm2) of the head unit 252_1 and the second part U2 (discharging amount=Vm2) of the head unit 252_2 correspond to each other.

Next, the discharging amount is Vm5≅Vm1+Vm2 from the boundary between the second part U2 and the first part U1 of the head unit 252_2. This region is because the second part U2 (discharging amount=Vm2) of the head unit 252_1 and the first part U1 (discharging amount=Vm1) of the head unit 252_2 correspond to each other.

Next, the discharging amount is Vm3≅2×Vm1 from the boundary between the second part U2 and the first part U1 of the head unit 252_1. This region is because the first part U1 (discharging amount=Vm1) of the head unit 252_1 and the first part U1 (discharging amount=Vm1) of the head unit 252_2 correspond to each other.

Next, the discharging amount is Vm5≅Vm1+Vm2 from the boundary between the first part U1 and the third part U3 of the head unit 252_2. This region is because the first part U1 (discharging amount=Vm1) of the head unit 252_1 and the third part U3 (discharging amount=Vm2) of the head unit 252_2 correspond to each other.

The discharging amount is Vm4≅2×Vm2 from the boundary between the first part U1 and the third part U3 of the head unit 252_1. This region is because the third part U3 (discharging amount=Vm2) of the head unit 252_1 and the third part U3 (discharging amount=Vm2) of the head unit 252_2 correspond to each other, or the third part U3 (discharging amount=Vm2) of the head unit 252_1 and the second part U2 (discharging amount=Vm2) of the head unit 252_3 correspond to each other.

As a result, in the third disposition form, the difference in the discharging amount between the regions adjacent to each other on the Y axis is Vm3−Vm5≅Vm1−Vm2, at the two boundaries of (1) the boundary between the second part U2 and the first part U1 of the head unit 252_1, (2) the boundary between the first part U1 and the third part U3 of the head unit 252_2.

Further, in the third disposition form, the difference in the discharging amount between the regions adjacent to each other on the Y axis is Vm5−Vm4≅Vm1−Vm2, at the two boundaries of (3) the boundary between the second part U2 and the first part U1 of the head unit 252_2, and (4) the boundary between the first part U1 and the third part U3 of the head unit 252_1. That is, the difference in discharging amount becomes Vm1−Vm2 at the four boundaries.

On the other hand, as described above, in the reference example, the difference in the discharging amount between the regions adjacent to each other on the Y axis is 2×(Vm1−Vm2). When comparing the third disposition form with the reference example, it is expressed such that Vm1−Vm2<2×(Vm1−Vm2), and thus the difference in the discharging amount of the third disposition form is smaller than that of the reference example by Vm1−Vm2. Therefore, the local difference in density can be reduced in the image recorded on the recording medium.

As described above, according to the third disposition form, it is possible to reduce the local difference in density and suppress the deterioration of the image quality.

1-8. Effects of First Embodiment

As can be understood from the above, the liquid discharging apparatus 100 has head units 252_1 and 252_2 provided with the plurality of nozzles N that discharge the ink, which is an example of a liquid. The head unit 252_1 corresponds to "a first head unit", and the head unit 252_2 corresponds to "a second head unit".

Each of the head units 252_1 and 252_2 includes the first part U1, and the second part U2 in which the widths in the X1 direction or the X2 direction are shorter than that of the first part U1. The positions of the first part U1 and the second part U2 are different from each other in the Y1 direction or the Y2 direction.

The first part U1 included in the head unit 252_1 corresponds to "a first part" in which a part of the plurality of nozzles N included in the head unit 252_1 is provided. On the other hand, the first part U1 included in the head unit 252_2 corresponds to "a fourth part" in which a part included in the plurality of nozzles N included in the head unit 252_2 is provided. The second part U2 of the head unit 252_1 corresponds to "a second part" in which a part of the plurality of nozzles N included in the head unit 252_1 is provided. On the other hand, the second part U2 of the head unit 252_2 corresponds to "a fifth part" in which a part of the plurality of nozzles N included in the head unit 252_2 is provided.

Each of the head units 252_1 and 252_2 are disposed side by side in the X1 direction or the X2 direction so that at least a part of the second part U2 that is included in the head unit 252_1 and the second part U2 that is included in the head unit 252_2 do not overlap with each other in the Y1 direction or the Y2 direction. According to the above configuration, it is possible to suppress the overlapping of the regions in which the discharging amount becomes the minimum, as compared with the configuration in which the second parts U2 are overlapped with each other in the Y1 direction or the Y2 direction as in the reference example, and thus the deterioration of the printing quality can be reduced.

The Y1 direction or the Y2 direction corresponds to "a first direction". The Y2 direction corresponds to "a first side" that is one side of the Y1 direction or the Y2 direction, and the Y1 direction corresponds to "a second side" that is the other side of the Y1 direction or the Y2 direction. The X1 direction or the X2 direction corresponds to "a second direction" intersecting the Y1 direction or the Y2 direction.

Further, each of the plurality of nozzles N included in the head unit 252_1 corresponds to "a first nozzle". On the other hand, each of the plurality of nozzles N included in the head unit 252_2 corresponds to "a second nozzle".

Further, in the first embodiment, as in the first disposition form and the second disposition form of the head unit 252, it is desirable that the head unit 252_1 and the head unit 252_2 are disposed side by side in the X1 direction or the X2 direction so that all of the second part U2 of the head unit 252_1 and the second part U2 of the head unit 252_2 do not overlap with each other in the Y1 direction or the Y2 direction. In other words, for the second part U2 included in the head unit 252_1 and the second part U2 included in the head unit 252_2, when the overlapping region in the Y1 direction or the Y2 direction decreases, it is possible to suppress the overlapping of the regions having the smallest discharging amount, and thus the deterioration in printing quality can be reduced.

When the second disposition form and the third disposition form are compared, in the second disposition form, the range of the discharging amount Vm4, which is between the minimum and the maximum of the total discharging amount in the Y1 direction or the Y2 direction, coincides with the length of the circulation head Hn, while in the third disposition form, the range of the discharging amount Vm4 is 0.5 times the length of the circulation head Hn. Therefore, it can be said that the discharging amount in the second disposition form changes more gently than in the third disposition form. When the discharging amount changes gently, the difference in discharging amount tends to be difficult to be visually recognized. Therefore, in the second disposition form, the difference in the discharging amount is less visually recognizable than in the third disposition form, and thus the deterioration in the printing quality can be reduced.

Further, each of the head units 252_1 and 252_2 further includes the third part U3 in which the width in the X1 direction or the X2 direction is shorter than that of the first part U1. The second part U2 and the third part U3 are different from each other in the position in the Y1 direction or the Y2 direction and are different from each other in the position in the X1 direction or the X2 direction. Further, as illustrated in FIGS. 4 and 5, each of the plurality of nozzles N provided in the head units 252_1 and 252_2, is provided in any of the first part U1, the second part U2, and the third part U3. That is, the nozzles N are not provided in a part other than the first part U1, the second part U2, and the third part U3 in the head unit 252_1 or 252_2. Therefore, it is easy to design the head units 252_1 and 252_2 that can reduce the installation space as described above.

The third part U3 of the head unit 252_1 corresponds to "a third part" in which a part of the plurality of nozzles N included in the head unit 252_1 is provided. On the other hand, the third part U3 of the head unit 252_2 corresponds to "a sixth portion" in which a part of the plurality of nozzles N included in the head unit 252_2 is provided.

Further, the head units 252_1 and 252_2 are disposed side by side in the X1 direction or the X2 direction so that at least a part of the second part U2 of the head unit 252_1 and the third part U3 of the head unit 252_2 do not overlap with each other in the Y1 direction or the Y2 direction, at least part of the third part U3 of the head unit 252_1 and the second part U2 of the head unit 252_2 do not overlap with each other in the Y1 direction or the Y2 direction, and at least a part of the third part U3 of the head unit 252_1 and the third part U3 of the head unit 252_2 do not overlap with each other in the Y1 direction or the Y2 direction. That is, by not overlapping with each other between the second parts U2, between the second part U2 and the third part U3, and between the third parts U3 in the Y1 direction or the Y2 direction, the regions having the smallest discharging amount do not overlap with each other, and the difference in the discharging amount becomes small, thereby the deterioration in printing quality can be reduced.

Further, as illustrated in FIGS. 4 and 5, in the head unit 252_1, the second part U2 is coupled to the first part U1 in the Y2 direction with respect to the first part U1. On the other hand, the third part U3 is coupled to the first part U1 in the Y1 direction with respect to the first part U1. Therefore, it is easy to design the head unit 252_1 that can reduce the installation space as described above.

Further, as illustrated in FIG. 5, in the head unit 252_1, the end surface E2 of the second part U2 on a third side that is one side of the X1 direction or the X2 direction has the same position as the end surface E1*a* of the first part U1 on the third side in the X1 direction or the X2 direction. In other words, the end surface E2 and the end surface E1*a* form a continuous plane. Similarly, the end surface E3 of the third part U3 on a fourth side that is the other side of the X1 direction or the X2 direction has the same position as the end surface E1*b* of the first part U1 on the fourth side in the X1 direction or the X2 direction. Therefore, as compared with the case where a step is provided between the end surface E2 and the end surface E1*a* or a step is provided between the end surface E3 and the end surface E1*b*, the head unit 252_1 and the head unit 252_2 can be densely disposed in the X1 direction or the X2 direction.

As illustrated in FIG. 5, each of the head units 252_1 and 252_2 includes a circulation head H1 in which one part is positioned in the second part U2 and the other part is positioned in the first part U1, and a circulation head H2 in which one part is positioned in the third part U3 and the other part is positioned in the first part U1. Therefore, the plurality of nozzles N can be evenly disposed along the Y axis over the first part U1, the second part U2, and the third part U3.

The circulation head H1_1 included in the head unit 252_1 corresponds to "a first head" in which a part of the plurality of nozzles N included in the head unit 252_1 is provided. The circulation head H2_1 included in the head unit 252_1 corresponds to "a second head" in which a part of the plurality of nozzles N included in the head unit 252_1 is provided. On the other hand, the circulation head H1_2 included in the head unit 252_2 corresponds to "a third head" in which a part of the plurality of nozzles N included in the head unit 252_2 is provided. The circulation head H2_2 included in the head unit 252_2 corresponds to "a fourth head" in which a part of the plurality of nozzles N included in the head unit 252_2 is provided.

As illustrated in FIG. 5, each of the head units 252_1 and 252_2 has, in addition to the circulation heads H1 and H2 described above, a circulation head H3 positioned in the first part U1 and a circulation head H4 positioned in the first part U1 at a position different from the circulation head H3 in the Y1 direction or the Y2 direction. In the configuration using the circulation heads H1 to H4, compared to the configuration using only the circulation heads H1 and H2, it is possible to increase the number of nozzles N included in the head units 252_1 and 252_2 without increasing the number of nozzles N in the circulation heads H1 and H2. Therefore, it is easy to increase the number of nozzles N included in the head units 252_1 and 252_2.

The circulation head H3_1 included in the head unit 252_1 corresponds to "a fifth head" in which a part of the plurality of nozzles N included in the head unit 252_1 is provided. The circulation head H4_1 included in the head unit 252_1 corresponds to "a sixth head" in which a part of the plurality of nozzles N included in the head unit 252_1 is provided. On the other hand, the circulation head H3_2 included in the head unit 252_2 corresponds to "a seventh head" in which a part of the plurality of nozzles N included in the head unit 252_2 is provided. The circulation head H4_2 included in the head unit 252_2 corresponds to "an eighth head" in which a part of the plurality of nozzles N included in the head unit 252_2 is provided.

Further, as illustrated in FIG. 3, each of the head units 252_1 and 252_2 further includes a holder 33 in which the circulation heads H1 and H2 are disposed. Therefore, the circulation heads H1 and H2 can be integrated by the holder 33. In addition to the circulation heads H1 and H2, the circulating heads H3 and H4 are disposed in the holder 33 of the present embodiment. Therefore, the circulation heads H1 to H4 are integrated by the holder 33. The holder 33 included in the head unit 252_1 corresponds to "a first holder". On the other hand, the holder 33 included in the head unit 252_2 corresponds to "a second holder".

Further, as illustrated in FIG. 3, each of the head units 252_1 and 252_2 further includes a fixing plate 36 that fixes the circulation heads H1 and H2 to the holder 33. Therefore, the integrity of the circulation heads H1 and H2 can be enhanced as compared with the configuration in which the fixing plate 36 is not used. The fixing plate 36 of the present embodiment fixes the circulation heads H1 and H2 as well as the circulation heads H3 and H4 to the holder 33. Therefore, the integrity of the circulation heads H1 to H4 is enhanced. The fixing plate 36 included in the head unit 252_1 corresponds to "a first fixing plate". On the other hand, the fixing plate 36 included in the head unit 252_2 corresponds to "a second fixing plate".

As illustrated in FIG. 5, each of the circulation heads H1 and H2 has nozzle rows La and Lb. Therefore, the pitch between the nozzles N in the nozzle row La or Lb can be reduced as compared with the configuration in which the nozzle row La or Lb extends over the circulation head H1 and the circulation head H2. Each of the nozzle rows La and Lb included in the head unit 252_1 corresponds to "a first nozzle row" in which a part of the plurality of nozzles N included in the head unit 252_1 is arranged in the Y1 direction or the Y2 direction. On the other hand, each of the nozzle rows La and Lb included in the head unit 252_2 corresponds to "a second nozzle row" in which a part of the plurality of nozzles N included in the head unit 252_2 is arranged in the Y1 direction or the Y2 direction.

As illustrated FIGS. 8, 9, and 10, the liquid discharging apparatus 100 further includes a head unit 252_3 provided with a plurality of nozzles N that discharge ink. The head unit 252_3 corresponds to "a third head unit". Further, each of the plurality of nozzles N included in the head unit 252_3 corresponds to "a third nozzle".

The head unit 252_3 includes the first part U1, and the second part U2 in which the widths in the X1 direction or the X2 direction are shorter than that of the first part U1. The positions of the first part U1 and the second part U2 are different from each other in the Y1 direction or the Y2 direction.

The first part U1 included in the head unit 252_3 corresponds to "a seventh part" in which a part of the plurality of nozzles N included in the head unit 252_1 is provided. The second part U2 of the head unit 252_3 corresponds to "an eighth part" in which a part of the plurality of nozzles N included in the head unit 252_3 is provided.

As illustrated in FIGS. 8, 9, and 10, the head unit 252_2 and the head unit 252_3 are disposed at different positions in the Y1 direction or the Y2 direction.

The head unit 252_1 and the head unit 252_3 are disposed side by side in the X1 direction or the X2 direction so that at least a part of the second part U2 that is included in the head unit 252_1 and the second part U2 that is included in the head unit 252_3 do not overlap with each other in the Y1 direction or the Y2 direction. According to the above configuration, since the difference in discharging amount is canceled out, as compared with the configuration in which the second parts U2 are overlapped with each other in the Y1 direction or the Y2 direction as in the reference example, and thus the deterioration of the printing quality can be reduced.

As illustrated in FIGS. 8, 9, and 10, the head unit 252_2 and the head unit 252_3 are disposed at the same position in the X1 direction or the X2 direction. Therefore, the disposition density of the nozzles N in the Y1 direction or the Y2 direction can be increased, and as a result, the printing speed can be increased.

2. Modification Example

The form illustrated above may be variously modified. A specific aspect of modification that can be applied to the above-described embodiments is illustrated below. Any two or more aspects selected from the following examples can be appropriately combined within a range not inconsistent with each other.

1. In the first embodiment, an example in which the shifting ΔL is twice the length, an example in which the shifting ΔL is one time the length, and an example in which the shifting ΔL is 0.5 times the length of the circulation head Hn in the Y1 direction or the Y2 direction are given, but if the shifting ΔL is not 0, any value may be used. For example, the shifting ΔL may be 0.1 times the length of the circulation head Hn in the Y1 direction or the Y2 direction, or may be the distance between the adjacent nozzles N in the Y1 direction or the Y2 direction.

2. In the above-described embodiment, the number of circulation heads Hn included in one head unit 252 is four, but the number of circulation heads Hn included in one head unit 252 may be three or less or five or more.

Figure 12:
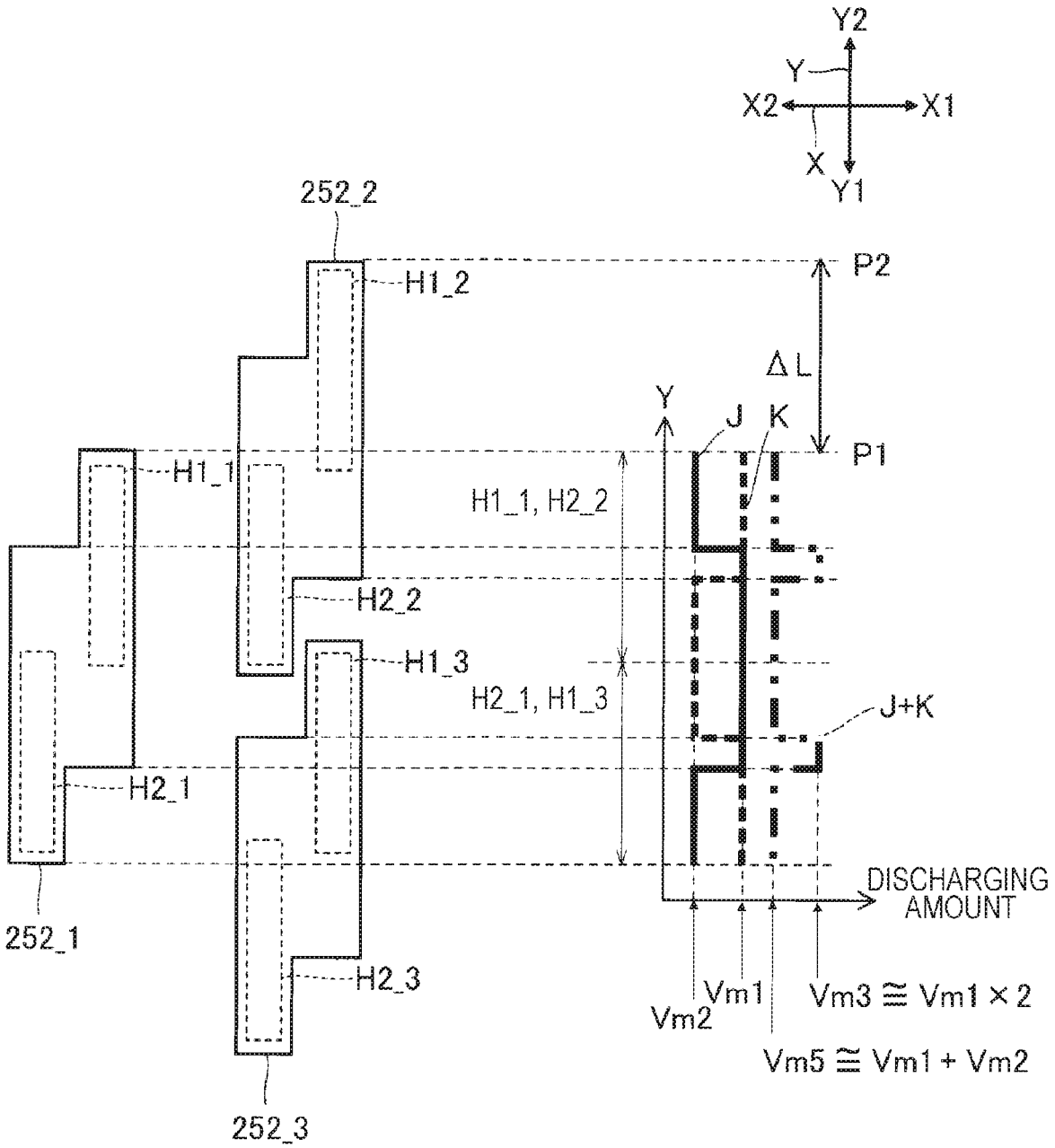
FIG. 12 is a diagram illustrating a relationship between a disposition form of two head units and discharging amounts of ink in a modification example.

FIG. 12 is a diagram illustrating a relationship between the disposition forms of the two head units 252_1 and 252_2 and the discharging amounts of the ink in the modification example. The head units 252_1 and 252_2 illustrated in FIG. 12 include two circulation heads H1 and H2. In the modification example illustrated in FIG. 12, the shifting ΔL between the position P1 of the head unit 252_1 and the position P2 of the head unit 252_2 in the Y1 direction or the Y2 direction coincides with the length of the circulation head Hn in the Y1 direction or the Y2 direction.

As indicated in the change J of the discharging amount of the ink in FIG. 12, in the head unit 252_1, the discharging amount Vm1 from the nozzle N provided in the first part U1 is larger than the discharge amount Vm2 from the nozzle N provided in the second part U2 and the third part U3. As illustrated by the change K in the discharging amount in FIG. 12, the discharging amount Vm1 from the nozzle N in the head units 252_2 and 252_3 is larger than the discharging amount Vm2 from the nozzle N in the head units 252_2 and 252_3. The positions of the head units 252_2 and 252_3 in which the discharging amount becomes Vm1, are the first part U1 included in the circulation head H2_2 and the first part U1 included in the circulation head H1_3. The positions of the head units 252_2 and 252_3 in which the discharging amount becomes Vm2, are the third part U3 included in the circulation head H2_2 and the second part U2 included in the circulation head H1_3. Since the change J in the discharging amount, the change K in the discharging amount, and the change J+K in the total discharging amount in the modification example can be derived in the same manner as the first disposition form of the first embodiment, the details thereof will be omitted.

Since the shifting ΔL coincides with the length of the circulation head Hn in the Y1 direction or the Y2 direction, the circulation head H2_2 corresponds to the region on the medium 11 to which the circulation head H1_1 corresponds, and the circulation head H1_3 corresponds to the region on the medium 11 to which the circulation head H2_1 corresponds.

As a result, as illustrated by the change J+K in the total discharging amount in FIG. 12, the difference in the discharging amount between the regions adjacent to each other on the Y axis is Vm3−Vm5=Vm1−Vm2, at the four boundaries of (1) the boundary between the second part U2 and the first part U1 of the head unit 252_1, (2) the boundary between the second part U2 and the third part U3 of the head unit 252_2, (3) the boundary between the second part U2 and the first part U1 of the head unit 252_3, and (4) the boundary between the first part U1 and the third part U3 of the head unit 252_1.

Further, when viewed on the entire Y axis, the maximum discharging amount is Vm3 2×Vm1, the minimum is Vm5≅Vm1+Vm2, and the difference is Vm1−Vm2.

As described above, also in the modification example, it is possible to reduce the local difference in density and the overall unevenness in density, and suppress the deterioration of the image quality.

3. In the above-described embodiment, the plurality of head units 252 supported by the support body 251 have the same configuration, but the configuration of the head unit 252 corresponding to the first head unit and the configuration of the head unit 252 corresponding to the second head unit may be different from each other.

4. In the above-described embodiment, the sub tank 13 is provided outside the head unit 252, and the ink is circulated between the head unit 252 and the sub tank 13, but instead of the sub tank, any system may be used as long as the system circulates ink between the head unit 252 and the outside of the head unit 252. For example, the ink may be circulated between the head unit 252 and the liquid container 12.

5. In the above-described embodiment, the serial type liquid discharging apparatus in which the transporting body 241 having the head unit 252 mounted thereon is reciprocated has been exemplified, but the present disclosure can be applied to a line type liquid discharging apparatus in which a plurality of nozzles N are distributed over the entire width of the medium 11.

6. The liquid discharging apparatus exemplified in the above-described embodiment can be adopted not only in an apparatus dedicated to printing but also in various apparatus such as a facsimile apparatus and a copying machine. Moreover, the application of the liquid discharging apparatus is not limited to printing. For example, a liquid discharging apparatus that discharges a solution of a coloring material is utilized as a manufacturing apparatus that forms a color filter of a display apparatus such as a liquid crystal display panel. Further, a liquid discharging apparatus that discharges a solution of a conductive material is utilized as a manufacturing apparatus that forms wiring or electrodes of a wiring substrate. Further, a liquid discharging apparatus that discharges a solution of an organic substance related to a living body is utilized, for example, as a manufacturing apparatus that manufactures a biochip.

7. The circulation head Hn illustrated in the above-described embodiment is formed by laminating a plurality of substrates, which are not shown in the figure, but the above-mentioned each component of the circulation head Hn is appropriately provided. For example, the first nozzle row La and the second nozzle row Lb are provided on a nozzle substrate. The first liquid storage chamber Ra and the second liquid storage chamber Rb are provided on a reservoir substrate. The plurality of first pressure chambers Ca and the plurality of second pressure chambers Cb are provided on a pressure chamber substrate. The plurality of first driving elements Ea and the plurality of second driving elements Eb are provided on an element substrate. One or more of the above nozzle substrate, reservoir substrate, pressure chamber substrate, and element substrate are individually provided for each circulation head Hn. For example, when the nozzle substrate is provided individually for each circulation head Hn, one or more of the reservoir substrate, the pressure chamber substrate, and the element substrate may be commonly provided for the plurality of circulation heads Hn in the head unit 252. Further, when the reservoir substrate and the pressure chamber substrate are individually provided for each circulation head Hn, the nozzle substrate or the like may be provided commonly for the plurality of circulation heads Hn in the head unit 252. Furthermore, the driving circuits for driving the plurality of first driving elements Ea and the plurality of second driving elements Eb may be provided individually for each circulation head Hn, or may be provided commonly for the plurality of circulation heads Hn in the head unit 252.

What is claimed is:

1. A liquid discharging apparatus comprising:

a first head unit provided with a plurality of first nozzles that discharge a liquid; and a second head unit provided with a plurality of second nozzles that discharge the liquid, wherein the first head unit includes a first part in which a part of the plurality of first nozzles is provided, and a second part in which a part of the plurality of first nozzles is provided, a position in a first direction is different from that of the first part, and a width is shorter than a width of the first part in a second direction intersecting with the first direction, the second head unit includes a fourth part in which a part of the plurality of second nozzles is provided, and a fifth part in which a part of the plurality of second nozzles is provided, a position in the first direction is different from that of the fourth part, and a width is shorter than a width of the fourth part in the second direction, and the first head unit and the second head unit are disposed side by side in the second direction such that at least a part of the second part and at least a part of the fifth part do not overlap with each other in the first direction when viewed from the second direction, and at least a part of the first part and at least a part of the fourth part overlap with each other in the first direction when viewed from the second direction.

2. The liquid discharging apparatus according to claim 1, wherein the first head unit and the second head unit are disposed side by side in the second direction such that an entirety of the second part and an entirety of the fifth part do not overlap with each other in the first direction.

3. The liquid discharging apparatus according to claim 1, wherein the first head unit further includes a third part in which a part of the plurality of first nozzles is provided, each of a position in the first direction and a position in the second direction is different from that of the second part, and a width is shorter than a width of the first part in the second direction, the second head unit further includes a sixth part in which a part of the plurality of second nozzles is provided, each of a position in the first direction and a position in the second direction is different from that of the fifth part, and a width is shorter than a width of the fourth part in the second direction, each of the plurality of first nozzles is provided in any of the first part, the second part, and the third part, and each of the plurality of second nozzles is provided in any of the fourth part, the fifth part, and the sixth part.

4. The liquid discharging apparatus according to claim 3, wherein the first head unit and the second head unit are disposed side by side in the second direction such that at least a part of the second part and at least a part of the sixth part do not overlap with each other in the first direction, at least a part of the third part and at least a part of the fifth part do not overlap with each other in the first direction, and at least a part of the third part and at least a part of the sixth part do not overlap with each other in the first direction.

5. The liquid discharging apparatus according to claim 3, wherein the second part is coupled to the first part on a first side that is one side of the first direction with respect to the first part, and the third part is coupled to the first part on a second side that is the other side of the first direction with respect to the first part.

6. The liquid discharging apparatus according to claim 3, wherein an end surface of the second part on a third side that is one side of the second direction has the same position as an end surface of the first part on the third side, in the second direction, and an end surface of the third part on a fourth side that is the other side of the second direction has the same position as an end surface of the first part on the fourth side, in the second direction.

7. The liquid discharging apparatus according to claim 3, wherein the first head unit includes a first head in which a part of the plurality of first nozzles is provided, and one part of the first head is positioned in the second part and the other part of the first head is positioned in the first part, and a second head in which a part of the plurality of first nozzles is provided, and one part of the second head is positioned in the third part and the other part of the second head is positioned in the first part, and the second head unit further includes a third head in which a part of the plurality of second nozzles is provided, and one part of the third head is positioned in the fifth part and the other part of the third head is positioned in the fourth part, and a fourth head in which a part of the plurality of second nozzles is provided, and one part of the fourth head is positioned in the sixth part and the other part of the fourth head is positioned in the fourth part.

8. The liquid discharging apparatus according to claim 7, wherein the first head unit further includes a fifth head in which a part of the plurality of first nozzles is provided and which is positioned in the first part, and a sixth head in which a part of the plurality of first nozzles is provided and which is different in position from the fifth head in the first direction and is positioned in the first part, and the second head unit further includes a seventh head in which a part of the plurality of second nozzles is provided and which is positioned in the fourth part, and an eighth head in which a part of the plurality of second nozzles is provided and which is different in position from the seventh head in the first direction and is positioned in the fourth part.

9. The liquid discharging apparatus according to claim 7, wherein the first head unit further includes a first holder in which the first head and the second head are disposed, and the second head unit further includes a second holder in which the third head and the fourth head are disposed.

10. The liquid discharging apparatus according to claim 9, wherein the first head unit further includes a first fixing plate that fixes the first head and the second head to the first holder, and the second head unit further includes a second fixing plate that fixes the third head and the fourth head to the second holder.

11. The liquid discharging apparatus according to claim 7, wherein each of the first head and the second head has a first nozzle row in which a part of the plurality of first nozzles is arranged in the first direction, and each of the third head and the fourth head has a second nozzle row in which a part of the plurality of second nozzles is arranged in the first direction.

12. The liquid discharging apparatus according to claim 1 further comprising:

a third head unit provided with a plurality of third nozzles that discharge the liquid, wherein the third head unit includes a seventh part in which a part of the plurality of third nozzles is provided, and an eighth part in which a part of the plurality of third nozzles is provided, a position in the first direction is different from that of the seventh part, and a width is shorter than a width of the seventh part in the second direction, the second head unit and the third head unit are disposed at positions different from each other in the first direction, and the first head unit and the third head unit are disposed side by side in the second direction such that at least a part of the second part and at least a part of the eighth part do not overlap with each other in the first direction.

13. The liquid discharging apparatus according to claim 12, wherein the second head unit and the third head unit are disposed at the same position in the second direction.

14. The liquid discharging apparatus according to claim 1, wherein the first head unit includes a first head in which a part of the plurality of first nozzles is provided, and one part of the first head is positioned in the second part, the second head unit includes a third head in which a part of the plurality of second nozzles is provided, and one part of the second head is positioned in the fifth part, the first head unit and the second head unit are disposed side by side in the second direction such that at least 0.1 times of width of the first head does not overlap to the third head in the first direction when viewed from the second direction.

15. The liquid discharging apparatus according to claim 1, wherein the first head unit includes a first head in which a part of the plurality of first nozzles is provided, and one part of the first head is positioned in the second part, the second head unit includes a third head in which a part of the plurality of second nozzles is provided, and one part of the second head is positioned in the fifth part, the first head unit and the second head unit are disposed side by side in the second direction such that at least 0.5 times of width of the first head does not overlap to the third head in the first direction when viewed from the second direction.

* * * * *